US009460593B2

(12) United States Patent
Acosta

(10) Patent No.: US 9,460,593 B2
(45) Date of Patent: Oct. 4, 2016

(54) CONTAINER BREACH DETECTOR SYSTEM

(71) Applicant: Enrique Acosta, Miami, FL (US)

(72) Inventor: Enrique Acosta, Miami, FL (US)

(73) Assignee: Container Seal Project Partners, LLC, Stuart, FL (US)

( * ) Notice: Subject to any disclaimer, the term of this patent is extended or adjusted under 35 U.S.C. 154(b) by 0 days.

(21) Appl. No.: 13/828,114

(22) Filed: Mar. 14, 2013

(65) Prior Publication Data

US 2015/0254948 A1 Sep. 10, 2015

(51) Int. Cl.

| | |
|---|---|
| ***E05B 45/06*** | (2006.01) |
| ***G08B 13/02*** | (2006.01) |
| ***G08B 13/08*** | (2006.01) |
| ***G08B 13/189*** | (2006.01) |
| ***G08B 13/19*** | (2006.01) |
| *G08B 13/16* | (2006.01) |

(52) U.S. Cl.

CPC ..... *G08B 13/02* (2013.01); *G08B 13/08* (2013.01); *G08B 13/1895* (2013.01); *G08B 13/19* (2013.01); *G08B 13/1663* (2013.01)

(58) Field of Classification Search

CPC ..... G06K 7/10366; G06K 7/10009; G06K 7/0008; G06K 19/0723; G06K 7/01; G08B 13/22; G08B 13/00; G08B 25/008; G08B 25/08; G08B 13/08; G08B 13/19645; G08B 15/00

USPC ..... 340/10.1–10.6, 541

See application file for complete search history.

(56) References Cited

U.S. PATENT DOCUMENTS

| | | | | |
|---|---|---|---|---|
| 4,750,197 | A | 6/1988 | Denekamp et al. | |
| 5,389,738 | A * | 2/1995 | Piosenka | G01K 7/01 174/528 |
| 5,790,025 | A * | 8/1998 | Amer | G08B 13/1481 250/221 |
| 7,019,683 | B2 | 3/2006 | Stevens et al. | |
| 7,135,976 | B2 | 11/2006 | Neff et al. | |
| 7,339,469 | B2 | 3/2008 | Braun | |
| 7,825,803 | B2 | 11/2010 | Neff et al. | |
| 7,828,346 | B2 | 11/2010 | Terry et al. | |
| 7,853,210 | B2 | 12/2010 | Meyers et al. | |
| 7,961,094 | B2 | 6/2011 | Breed | |
| 7,991,357 | B2 | 8/2011 | Meyers et al. | |
| 8,022,573 | B2 | 9/2011 | Powers et al. | |
| 8,026,792 | B2 | 9/2011 | Powers et al. | |
| 8,111,157 | B2 | 2/2012 | Diener et al. | |
| 8,115,620 | B2 | 2/2012 | Breed | |

(Continued)

*Primary Examiner* — Kerri McNally
*Assistant Examiner* — Sharmin Akhter
(74) *Attorney, Agent, or Firm* — Albert Bordas, P.A.

(57) ABSTRACT

A container breach detector system to monitor breaches of a transportation container. A self-contained container breach detector provides activation, status, and/or breach event date and time stamp data and a unique identification number of a communication tower, for a user to determine when and where authorized and/or unauthorized breaches of the transportation container occurred. Furthermore, the self-contained container breach detector serves as a recording device to record the activation, status, and/or breach event date and time stamp data; and communicates via various communication means including text via short message service, SMS, and/or e-mail. A container breach detector is intended for a one-time use only, to be discarded at destination. Each container breach detector has individual serial numbers. An encapsulating composition ensures that the self-contained container breach detector is used only once, and is not removed, recharged and reused, whereby removal of the encapsulating composition would damage its electrical system.

20 Claims, 27 Drawing Sheets

(56) References Cited

U.S. PATENT DOCUMENTS 8,138,917 B2 3/2012 Diener et al.
8,154,404 B2 4/2012 Diener et al.
8,159,338 B2 4/2012 Breed
8,446,276 B2 * 5/2013 Rice ..... H04B 7/1851 340/539.22
2004/0174259 A1 9/2004 Peel et al.
2004/0196152 A1 * 10/2004 Tice ..... G08B 25/10 340/539.26
2004/0233054 A1 11/2004 Neff et al.
2005/0046567 A1 * 3/2005 Mortenson ..... G06Q 10/047 340/539.13
2005/0195101 A1 9/2005 Stevens et al.
2005/0231365 A1 10/2005 Tester et al.
2006/0109106 A1 5/2006 Braun
2007/0085677 A1 4/2007 Neff et al.
2007/0241881 A1 10/2007 Golden
2007/0262861 A1 11/2007 Anderson et al.
2008/0047350 A1 2/2008 Atlas et al.
2008/0094209 A1 * 4/2008 Braun ..... G06Q 10/08 340/539.13
2008/0143523 A1 6/2008 Ekstrom
2008/0252084 A1 10/2008 Francis et al.
2008/0252450 A1 10/2008 Wandel
2009/0015400 A1 1/2009 Breed
2010/0117802 A1 5/2010 Easley et al.
2010/0300178 A1 * 12/2010 Naruishi ..... G01L 5/008 73/12.06
2011/0006895 A1 1/2011 Nelson
2011/0044207 A1 2/2011 Meyers et al.
2011/0227722 A1 * 9/2011 Salvat, Jr. ..... G01S 5/0027 340/539.1
2012/0112910 A1 * 5/2012 Meyers ..... G08B 13/08 340/547
2013/0002443 A1 * 1/2013 Breed ..... G01J 5/0846 340/686.1

* cited by examiner

CONTAINER BREACH DETECTOR SYSTEM

BACKGROUND OF THE INVENTION

1. Field of the Invention

The present invention relates to security systems, and more particularly, to breach detector systems for transportation containers.

2. Description of the Related Art

One of the closest references corresponds to U.S. Patent Application Publication No. 2009/0015400 published on Jan. 15, 2009 to Breed for a shipping container monitoring based on door status. However, it differs from the present invention because Breed teaches a remotely monitorable shipping container assembly including a shipping container including at least one door, a door status sensor for monitoring the open or closed status of the door(s) and a communications device mounted on the container and wirelessly transmitting information to one or more remote facilities including the status of the door(s) as monitored by the door status sensor. The remote facility may be for example, a facility interested in ensuring the integrity of the contents of the container, a facility which is charged with preventing theft of the contents of the containers, a law enforcement facility which is responsible for preventing transport of illegal cargo, and the like. A positioning system may be arranged on the container for determining a position thereof. The communications device is coupled to the positioning system and transmits the determined position of the container with the open or closed status of the door(s).

Another reference corresponds to U.S. Pat. No. 8,154,404 issued on Apr. 10, 2012 to Diener, et al. for a method and apparatus for detecting movement of a shipping container latch; U.S. Pat. No. 8,138,917 issued on Mar. 20, 2012 to Diener, et al. for a latch monitoring apparatus for a shipping container door; and U.S. Pat. No. 8,111,157 issued on Feb. 7, 2012 to Diener, et al.; all of them for an apparatus for detecting tampering with a latch mechanism. However, they differ from the present invention because Diener, et al. teaches a system, method, and apparatus for monitoring and detecting movement of components of a shipping container latch. A latch monitor may embody an electromagnetic sensing unit and a nearby magnet or light emitter for measuring and characterizing the profile of a nearby electromagnetic field. The field profile is monitored to detect a change in the profile, log the change, and report any abnormal disturbance to the electromagnetic field, indicating a breach of the integrity of a latching mechanism on a shipping container. An alert of a breach event may be sent via a communication network to an authority for response. The invention can distinguish authorized, incidental, and tampering events, and also store and upload an electronic manifest for a shipping container.

Another reference corresponds to U.S. Pat. No. 8,026,792 issued to Powers, et al. on Sep. 27, 2011 for a Global asset tracking enterprise system. However, it differs from the present invention because Powers teaches a system for operating a container lock mechanism that includes a housing, at least two lock members, the two lock members including a first lock member configured to engage a first portion of a container and a second lock member configured to engage a second portion of the container to mount the container lock mechanism outside of the container and lock at least one container door in a closed position. The system further includes a latching mechanism coupled to the first and second lock members, and a lock circuit at least partially enclosed within the housing. The lock circuit includes a first memory, a wireless module configured to receive a wireless signal and a lock controller coupled to the first memory, the wireless module and the latching mechanism and configured to receive commands related to operation of the lock mechanism, at least a portion of the commands being part of the wireless signal, to cause the latching mechanism to resist having the first and second lock members be disengaged from the first and second portions of the container when the first and second lock members are engaged to the first and second portions of the container, thereby locking the at least one container door in response to the received commands, and a battery coupled to the lock circuit and configured to provide electrical power to at least a portion of the lock circuit.

Another reference corresponds to U.S. Pat. No. 8,022,573 issued to Powers, et al. on Sep. 20, 2011 for a shipping container active lock release failsafe. However, it differs from the present invention because Powers teaches a lock mechanism to lock at least one door of a container in a closed position that includes a housing enclosing at least a portion of the lock mechanism, and a lock circuit at least partially enclosed within the housing. The lock circuit includes a main power supply, a backup power supply, a plurality of subsystems, and a lock controller coupled to the main power supply and the backup power supply. The lock controller is configured to receive commands related to operation of the lock mechanism, determine a battery level remaining in the main power supply, determine if the remaining battery level is below a threshold level, and cause the lock circuit to enter a lower power mode upon determining that the remaining battery level is below the threshold level. When in the lower power mode, at least a portion of the subsystems of the lock circuit are not powered, the lock controller receives power from the main power supply, and the lock controller monitors an interface to detect a command to unlock the lock mechanism.

Another reference corresponds to U.S. Patent Application Publication No. 2011/0006895 published on Jan. 13, 2011 to Nelson for an expendable tamper evident security seal. However, it differs from the present invention because Nelson teaches an expendable tamper evident seal system for monitoring a mechanism to which physical access is required in order to open or close an access-way, comprising: an embedding material moldable into a shape conforming to the mechanism and adapted to be applied to the mechanism; circuit components randomly embedded in the embedding material so as to be arranged in positions and orientations corresponding to the shape, whereby physical access to the mechanism that alters the shape of the embedding material correspondingly alters the positions and orientations of the circuit components in the material; and an electronic interrogation device (EID) including components that induce in the circuit components an electromagnetic spectral response indicative of the position of the EID relative to the positions and orientations of the circuit components in the material, and measure the spectral response.

Another reference corresponds to U.S. Patent Application Publication No. 2010/0117802 published on May 13, 2010 to Easley, et al. for a system and method for providing communications for container security. However, it differs from the present invention because Easley, et al. teaches a system for providing communications for container security. The system includes a sensing system for monitoring the contents of the container; a signal receiving element for receiving sensor data from the sensing system; a control element for analyzing received sensor data; a first transceiver element for receiving signals containing sensor data from within the container and for transmitting those signals outside of the container; and a satellite transceiver element for receiving signals from the first transceiver element and for forwarding the received signals via satellite uplink to a remote location.

Another reference corresponds to U.S. Patent Application Publication No. 2008/0047350 published on Feb. 28, 2008 to Atlas, et al. for the use of ultrasound for monitoring security of shipping containers. However, it differs from the present invention because Atlas, et al. teaches ultrasound signals transmitted from one or more ultrasonic transducers configured to be mounted within an interior of a shipping container that travel through the interior and are reflected by a reflector, e.g., a corner reflector. The reflected ultrasound is received by an ultrasonic receiver, which produces an output signal corresponding to the received ultrasound signal. If the ultrasonic transducer or the reflector is mounted on the door, the time of flight of the ultrasound signal can be used to determine the distance that the ultrasound signal travels. Opening the door changes this distance, which can be detected. Similarly, changes in ultrasound reflected from contents in the shipping container can be detected and used to detect changes in the contents, which may be caused by terrorist activity.

Another reference corresponds to U.S. Pat. No. 7,019,683 issued to Stevens, et al. on Mar. 28, 2006, previously published as U.S. Patent Application Publication No. 2005/0195101 on Sep. 8, 2005, for a shipping container security system. However, it differs from the present invention because Stevens teaches a security system that senses intrusions into a shipping container through the opening of doors, cutting an opening, or removing the doors from their hinges. Intrusion information is transmitted to a remote receiver without interrogation, thereby reducing power consumption. Sensing is accomplished by employing a range-gated micro-impulse radar ("RGR") that generates microwave pulses that bounce around the interior of the container. The RGR includes a range gate that enables measuring reflected signals during the time gate period that is set for the time it takes a pulse to propagate a maximum distance within the container and reflect back. A direct current signal level is produced that represents the average reflected signal level within the container, and a Doppler shift measurement is made that represents motion inside the container. The signals are conveyed to the transmitter for conveyance to the remote receiver.

Another reference corresponds to U.S. Pat. No. 8,159,338 issued to Breed on Apr. 17, 2012 for an asset monitoring arrangement and method. However, it differs from the present invention because Breed teaches an arrangement and method for monitoring an asset that includes a location determining system and a self-powered interior sensor and communication system which data about contents in the interior of the asset and transmits the data and the location of the asset. It includes a transmitter and receiver for communicating directly with a wireless ISP such that the data about the contents and the location of the asset are available to a user having access to the Internet and a user having access to the Internet can direct communications to the interior sensor and communications system. A triggering device is coupled to the interior sensor and communication system and arranged to detect an event, which might cause a change in the contents or condition of the asset. The triggering device directs the interior sensor and communication system to obtain data about the contents when such an event is detected.

Another reference corresponds to U.S. Pat. No. 8,115,620 issued to Breed on Feb. 14, 2012 for an asset monitoring using micropower impulse radar. However, it differs from the present invention because Breed teaches a arrangement and method for monitoring inanimate objects in an interior thereof includes a sensor system arranged to obtain data about the object by applying micropower impulse radar (MIR) transmissions into the interior of the asset, i.e., container volume monitoring using MIR, a location determining system arranged on the asset to monitor the location of the asset, and a communication system arranged on the asset and coupled to the sensor system and the location determining system. The communication system transmits the data about each object obtained by the sensor system and the location of the asset provided by the location determining system to one or more remote facilities, these remote facilities being those interested in the information about the objects in the asset being monitored.

Another reference corresponds to U.S. Pat. No. 7,961,094 issued to Breed on Jun. 14, 2011 for a perimeter monitoring techniques. However, it differs from the present invention because Breed teaches a method for monitoring borders or peripheries of installations includes arranging sensors periodically along the border at least partially in the ground, the sensors being sensitive to vibrations, infrared radiation, sound or other disturbances, programming the sensors to wake-up upon detection of a predetermined condition and receive a signal, analyzing the signal and transmitting a signal indicative of the analysis with an identification or location of the sensors. The sensors may include a processor embodying a pattern recognition system trained to recognize characteristic signals indicating the passing of a person or vehicle.

Another reference corresponds to U.S. Pat. No. 7,991,357 issued to Meyers, et al. on Aug. 2, 2011, and previously published as U.S. Patent Application Publication No. 2011/0044207 for an intelligent sensor open architecture for a container security system. U.S. Pat. No. 7,991,357 claims priority of U.S. Pat. No. 7,853,210. However, it differs from the present invention because Meyers, et al. teaches a system and method for interfacing with sensors using an open architecture and standards based approach. A sensor controller located on each container and any variety of one or more sensors are equipped with complementary short-range wireless communications devices. The sensor may adhere to a predefined interface specification such that it may be automatically commissioned into, and operation in conjunction with the sensor controller and the container security system.

Another reference corresponds to U.S. Pat. No. 7,828,346 issued to Terry, et al. on Nov. 9, 2010 for securing shipping container for transport. However, it differs from the present invention because Terry, et al. teaches a method for securing a shipping container for transport, and includes the steps of: providing a shipping container having a bolt-type seal lock module, a sensor module mounted to an interior surface of the shipping container configured to wirelessly communicate data to the bolt-type seal lock module, and an RF device mounted on an inside surface of a door of the shipping container; providing a bolt; associating the sensor module with the RF device such that the RF device is specifically coded with a sensor module to deter spoofing the short-range communication link formed between the RF device and the sensor module; associating the sensor module with the bolt-type seal lock such that the bolt-type seal lock is specifically coded with the sensor module to deter spoofing communications between the bolt-type seal lock and the sensor module; and sealing the shipping container.

Another reference corresponds to U.S. Pat. No. 7,825,803 issued on Nov. 2, 2010, which claims priority of U.S. Pat. No. 7,135,976 issued on Nov. 14, 2006, and previously published as U.S. Patent Application Publication Nos. 2007/0085677 & 2004/0233054, respectively, both issued to Neff, et al., for a wireless monitoring device. However, they differ from the present invention because Neff, et al. teaches a system including a method for monitoring changes in the status or condition of a container using one or more monitoring units mounted to the container. The monitoring units preferably include a power supply, sensors using reflective energy with programmable parameters, globally-unique sensor identification, recording capability on a timeline, long term memory and the ability to rebroadcast information on RFID radio technology. Programmable monitoring hardware in the monitoring unit detects significant changes in the sensor outputs as a triggering event. The programmable monitoring hardware includes memory for storing identification information for the container. The sensors which can include conventional devices that detect various forms of energy including visible light, infrared light, magnetic fields, radio frequency energy and sound. In one embodiment, a monitoring unit is mounted inside a shipping container suitable for long distance transport. The triggering event can be used for tamper detection security.

Another reference corresponds to U.S. Pat. No. 7,339,469 issued to Braun on Mar. 4, 2008, previously published as U.S. Patent Application Publication No. 2006/0109106, for a shipping container monitoring and tracking system. However, it differs from the present invention because Braun teaches a system for monitoring a container for transporting cargo. The system includes an onboard device attached to the container and a central computer system. The central computer system processes alerts transmitted by the onboard device. The onboard device includes a processor/sensor component and an antenna component. The processor/sensor component comprises a processor for controlling the device. The processor/sensor component also includes one or more sensor in communication with the processor for sensing container conditions. A satellite modem in the processor/sensor component transmits alerts relating to container conditions and other satellite communications. The antenna component includes a satellite antenna, which is connected to the satellite modem.

Another reference corresponds to U.S. Pat. No. 4,750,197 issued to Denekamp, et al. on Jun. 7, 1988 for an integrated cargo security system. However, it differs from the present invention because Denekamp teaches an integrated cargo transportation security system provided for a fleet of enclosed cargo transportation containers. Each container includes a subsystem including a door sensor for sensing access door opening and closure, a module unit including a connecting frame for a removable module and cabling leading to the door sensor. The identically appearing removable modules are configurable as active and passive. Each locks into the unit. The system includes a central data collection and processing facility for processing cargo trip data collected by at least one active module during a cargo trip of the container into a roadmap indicating travel route of the container during the trip and the time and location of significant event such as unauthorized opening of the cargo door. The module unit having an active module includes a self contained power supply, a location detector for detecting present location of said container, a clock, a central processor for generating a sequence of status numbers indicative of accumulated location, time and door status, and a memory for storing the sequence during the trip. The system further includes means for transferring the status number sequence to the central data collection and processing facility. A radio link may be provided to connect the container module to the central data facility in real time, and may be operated by authorized personnel at the container to signal predetermined conditions to the central facility.

Other patents describing the closest subject matter provide for a number of more or less complicated features that fail to solve the problem in an efficient and economical way. None of these patents suggest the novel features of the present invention.

SUMMARY OF THE INVENTION

The instant invention is a container breach detector system for transportation containers, which include shipping containers. More specifically, the instant invention is a container breach detector system to monitor breaches of a transportation container. A self-contained container breach detector provides activation, status, and/or breach event date and time stamp data for a user to determine when and where authorized and/or unauthorized breaches of the transportation container occurred. Furthermore, the self-contained container breach detector serves as a recording device to record the activation, status, and/or breach event date and time stamp data; and communicates via various communication means including text via short message service, SMS, and/or e-mail. The self-contained container breach detector is intended for a one-time use only, to be discarded at destination. Each self-contained container breach detector has individual serial numbers. An encapsulating composition ensures that the self-contained container breach detector is used only once, and is not removed, recharged and reused, whereby removal of the encapsulating composition would damage its electrical system.

Furthermore, the instant invention is a container breach detector system, comprising a self-contained container breach detector comprising a housing and an electrical system. The self-contained container breach detector is mounted within a transportation container and monitors breaches of the transportation container.

The electrical system comprises at least one ambient light sensor and at least one IR proximity and distance sensor, whereby the self-contained container breach detector provides activation, status, and/or breach event date and time stamp data to identify when and where authorized and/or unauthorized breaches of the transportation container occurred when the at least one ambient light sensor and/or the at least one IR proximity and distance sensor is activated.

The self-contained container breach detector further comprises an encapsulating composition. The encapsulating composition is an optically clear epoxy chemical composition filling within the housing to cover the electrical system. The encapsulating composition ensures that the self-contained container breach detector is used only once, whereby removal of the encapsulating composition damages the electrical system.

The self-contained container breach detector serves as a recording device to record the activation, status, and/or breach event date and time stamp data. The activation, status, and/or breach event date and time stamp data is communicated via communication means including text via short message service, SMS, and/or e-mail to communication towers, to an operations center having at least one server(s) and/or computer(s), via Internet to designated computers, and/or to cell phones.

The electrical system comprises a main printed circuit board; industrial, scientific and medical band radio circuitry; global system for mobile communications radio module circuitry comprising communication means; power circuitry comprising power means; sensors, wireless technology standard, and subscriber identity module card circuitry; and a central processing unit.

The sensors, wireless technology standard, and subscriber identity module card circuitry comprises sensors that are mounted onto the main printed circuit board facing outwardly. The industrial, scientific and medical band radio circuitry comprises remote control means to function as a remote control to request the activation, status, and/or breach event date and time stamp data to identify when and where authorized and/or unauthorized breaches of the transportation container occurred. The remote control means comprises an ISM power switch and an ISM radio.

The electrical system further comprises accelerometer circuitry comprising accelerometer means to measure proper acceleration. The accelerometer circuitry comprises an accelerometer. The accelerometer circuitry is configured to save power of the electrical system when the accelerometer measures the proper acceleration while the transportation container is traveling on a ship. The accelerometer may also record and/or trigger an alarm if it registers an impact or shock impact. Such an impact or shock impact may be the result of a drop, or sudden movement, impact or collision.

The housing comprises an exterior wall defined between a bottom edge and a top wall, and first and second lateral edges. Extending outwardly a predetermined distance from the exterior wall is a protruding wall. The protruding wall is cooperatively shaped to snugly accommodate components of the electrical system within the housing. Adhered onto the top wall is double-sided tape. Opposite the exterior wall is a rear edge. An outside diameter of the rear edge is of a cooperative shape, and slightly larger than an outside diameter of a main printed circuit board, to receive it, whereby the electrical system is embedded within the housing through the rear edge.

It is therefore one of the main objects of the present invention to provide a container breach detector system that is effective against tampering.

It is another object of this invention to provide a container breach detector system that comprises date and time stamp data, and communication tower locations, allowing for users to determine when and where a breach occurred.

It is another object of this invention to provide such a container breach detector system that is inexpensive to implement and monitor while retaining its effectiveness.

It is another object of this invention to provide a container breach detector system that is volumetrically efficient while in operation.

It is another object of this invention to provide a container breach detector system that is of a durable and reliable construction.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
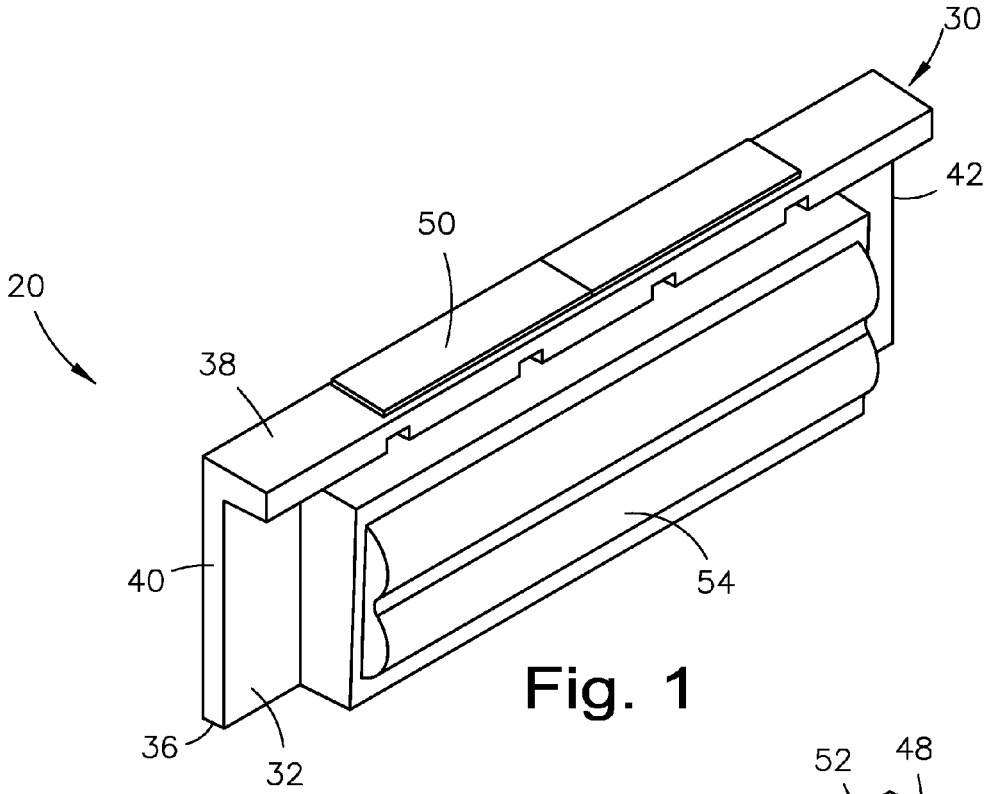
FIG. 1 is a first isometric view of a self-contained container breach detector.

Referring now to the drawings, the present invention is a container breach detector system and is generally referred to with numeral 10. It can be observed that it basically includes self-contained container breach detector 20 mounted within transportation container 170.

Figure 2:
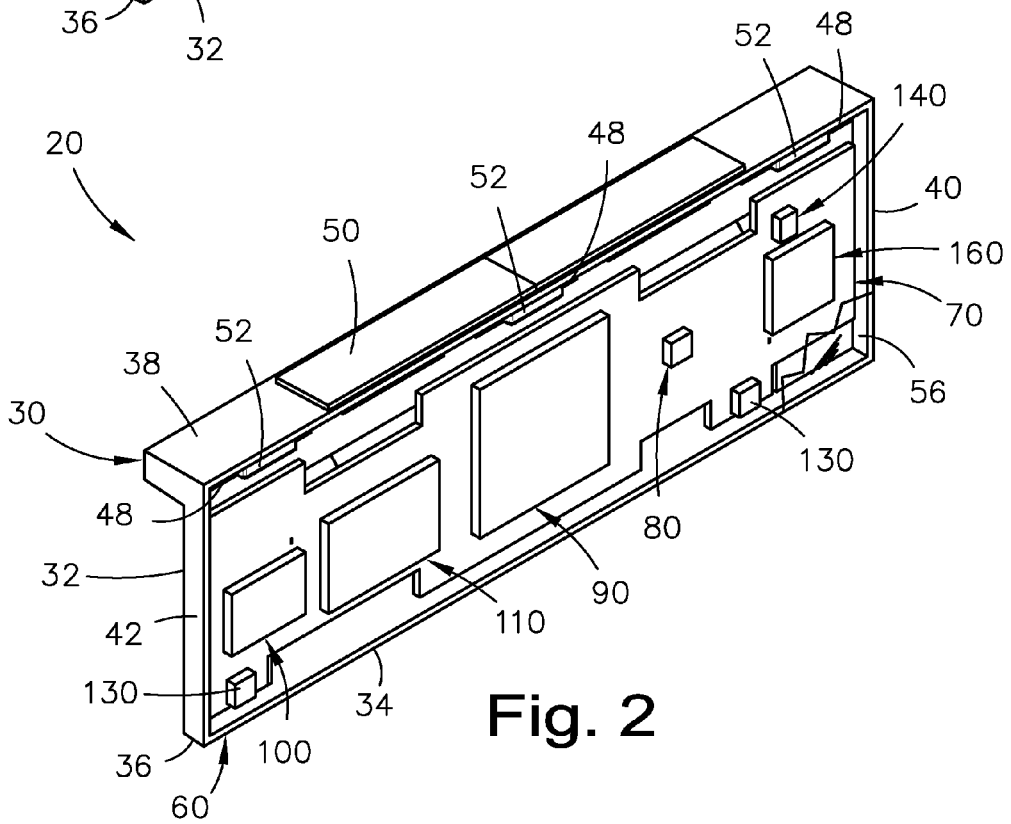
FIG. 2 is a second isometric view of the self-contained container breach detector.

As seen in FIGS. 1 and 2, self-contained container breach detector 20 comprises housing 30 and electrical system 60.

Housing 30 comprises exterior wall 32 defined between bottom edge 36 and top wall 38, and lateral edges 40 and 42. Extending outwardly a predetermined distance from exterior wall 32 is protruding wall 54. Protruding wall 54 is cooperatively shaped to snugly accommodate components of electrical system 60 within housing 30. Adhered onto top wall 38 is double-sided tape 50. Opposite exterior wall 32 is rear edge 34. In a preferred embodiment, an outside diameter of rear edge 34 is of a cooperative shape, and slightly larger than an outside diameter of main printed circuit board 70, to receive it, whereby electrical system 60 is embedded within housing 30 through rear edge 34.

Electrical system 60 may comprise main printed circuit board 70; industrial, scientific and medical (ISM) band radio circuitry 80; Global System for Mobile Communications (GSM) radio module circuitry 90; power circuitry 100; sensors, wireless technology standard, and subscriber identity module (SIM) card circuitry 110; accelerometer circuitry 140; de-bug printed circuit board 150, seen in FIGS. 7A-7D; and central processing unit (CPU) 160. Sensors, wireless technology standard, and SIM card circuitry 110 comprise sensors 130 that are mounted onto main printed circuit board 70, facing outwardly.

It is noted that GSM radio module circuitry 90 is a standard set to describe protocols for second-generation (2G) digital cellular networks used by mobile phones. The GSM standard was developed as a replacement for first generation (1G) analog cellular networks, and originally described a digital, circuit switched network optimized for full duplex voice telephony. This was expanded over time to include data communications, first by circuit switched transport, then packet data transport via GPRS (General Packet Radio Services) and EDGE (Enhanced Data rates for GSM Evolution or EGPRS). However, GSM radio module circuitry 90 may also comprise (3G) UMTS standards, fourth generation (4G) LTE Advanced standards, and additional standards to enable communication of self-contained container breach detector 20.

Self-contained container breach detector 20 further comprises encapsulating composition 56. In a preferred embodiment, encapsulating composition 56 is an optically clear epoxy chemical composition filling within housing 30 to cover electrical system 60. More specifically, when manufacturing self-contained container breach detector 20, encapsulating composition 56 is poured into housing 30. Then once main printed circuit board 70 is presented onto housing 30, a coating of encapsulating composition 56 is also placed onto the exterior side of main printed circuit board 70.

Figure 3:
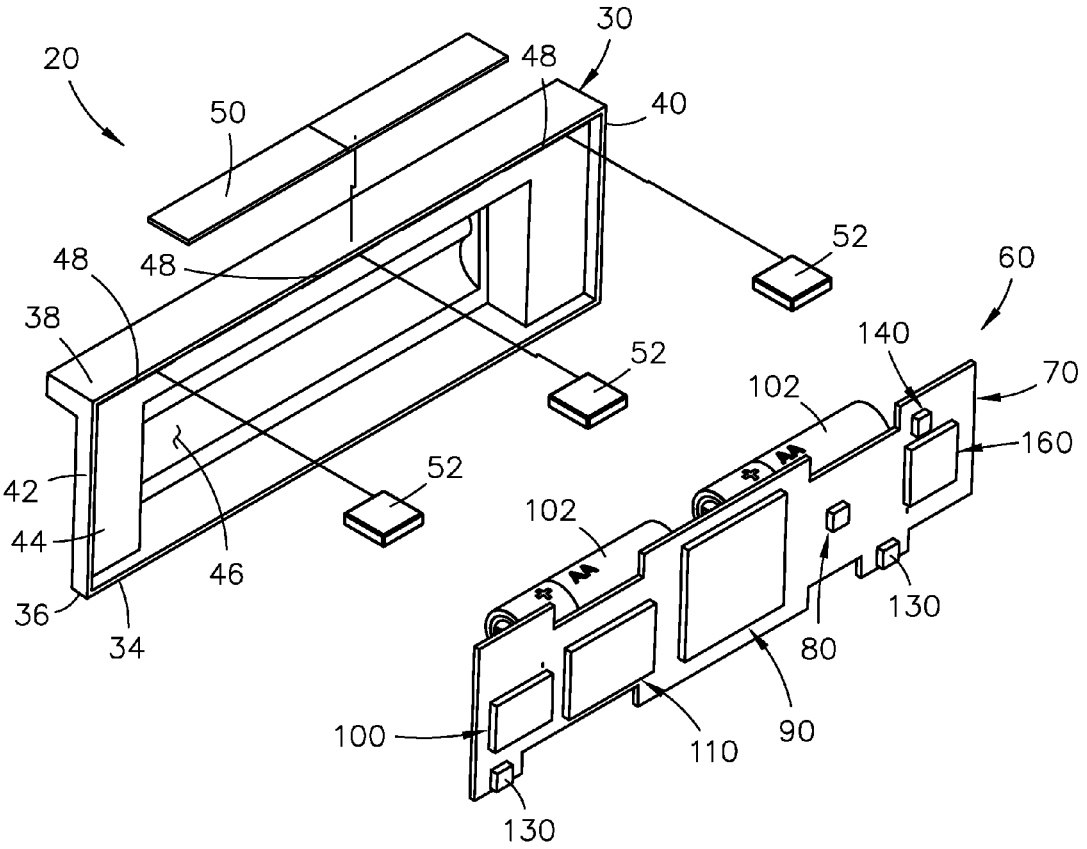
FIG. 3 is an exploded view of the self-contained container breach detector.

As best seen in FIG. 3, housing 30 comprises interior wall 44 that defines a stop for main printed circuit board 70 when biased against it when manufacturing self-contained container breach detector 20. Housing 30 further defines cavity 46 to receive components of electrical system 60 therein. Housing 30 further comprises at least one slot 48 on an interior side of top wall 38 for each to receive its respective at least one magnet 52. As seen in this illustration, power circuitry 100 may comprise at least one battery 102. In a preferred embodiment, at least one battery 102 is a lithium battery. It is noted that protruding wall 54 is cooperatively shaped to snugly accommodate components of electrical system 60 within housing 30, and specifically at least one battery 102.

Figure 4:
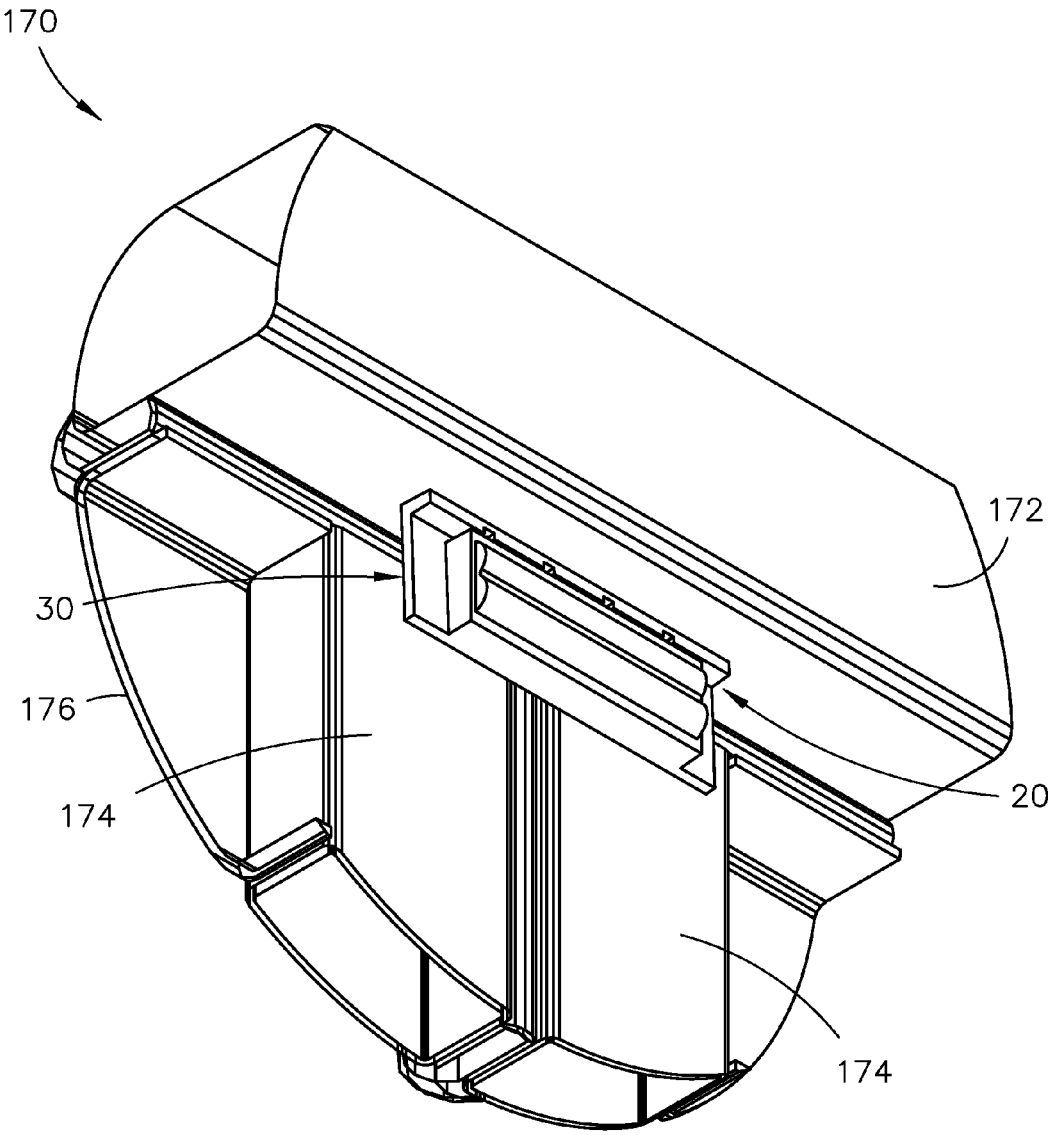
FIG. 4 is an isometric view of the self-contained container breach detector mounted internally within a transportation container.
Figure 5:
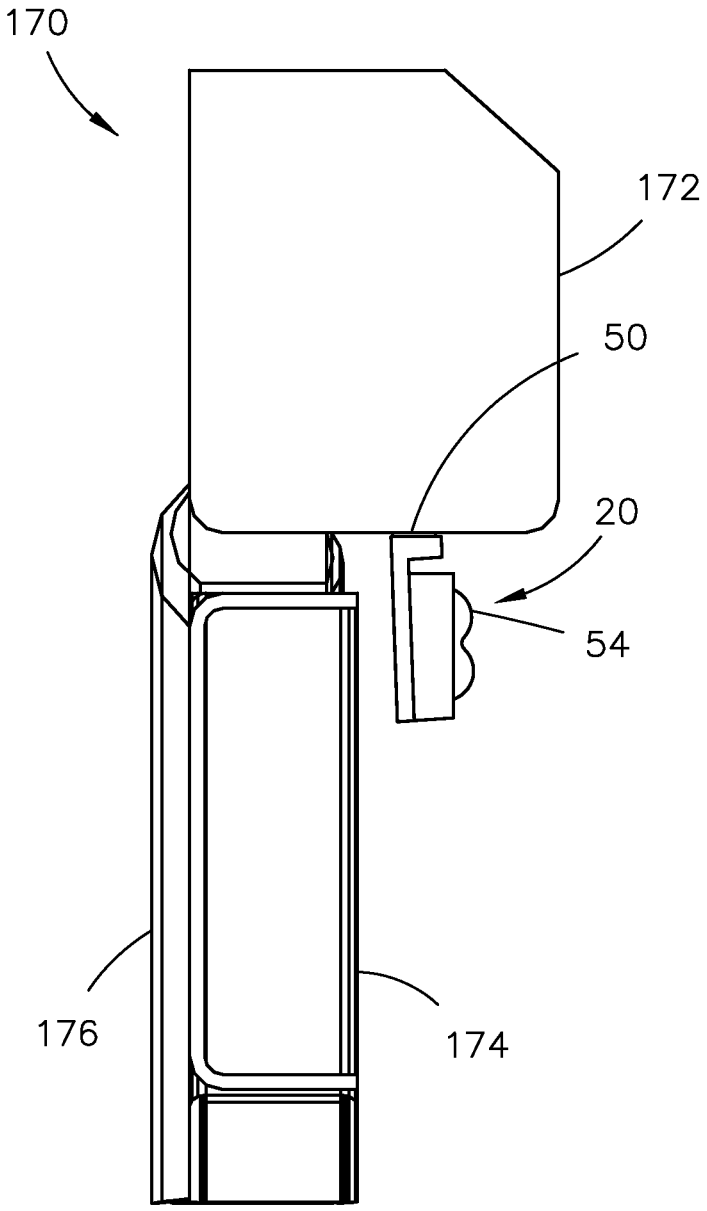
FIG. 5 is a side view of the self-contained container breach detector mounted internally within the transportation container.

As seen in FIGS. 4 and 5, self-contained container breach detector 20 is mounted within transportation container 170. Transportation container 170 is also defined as a shipping container comprising at least one door. The illustrated transportation container 170 comprises top frame 172, and doors having internal faces 174 and external faces 176. In a preferred embodiment, top frame 172 is of a ferromagnetic material, such as steel or iron. The ferromagnetism material is the basic mechanism by which certain materials form permanent magnets, or are attracted to magnets, such as at least one magnet 52. In a preferred embodiment, self-contained container breach detector 20 is mounted onto top frame 172 of transportation container 170. Self-contained container breach detector 20 remains secured onto top frame 172 with double-sided tape 50 and a predetermined magnetic force of at least one magnet 52. Furthermore, self-contained container breach detector 20 is mounted in an orientation such that sensors 130 face internal faces 174. More specifically, self-contained container breach detector 20 is mounted onto top frame 172 where the doors of transportation container 170 meet, and in the orientation such that sensors 130 face internal faces 174. Sensors 130 comprise at least one ambient light sensor 132, and at least one IR proximity and distance sensor 134, seen in FIGS. 11A-11D.

Figure 6:
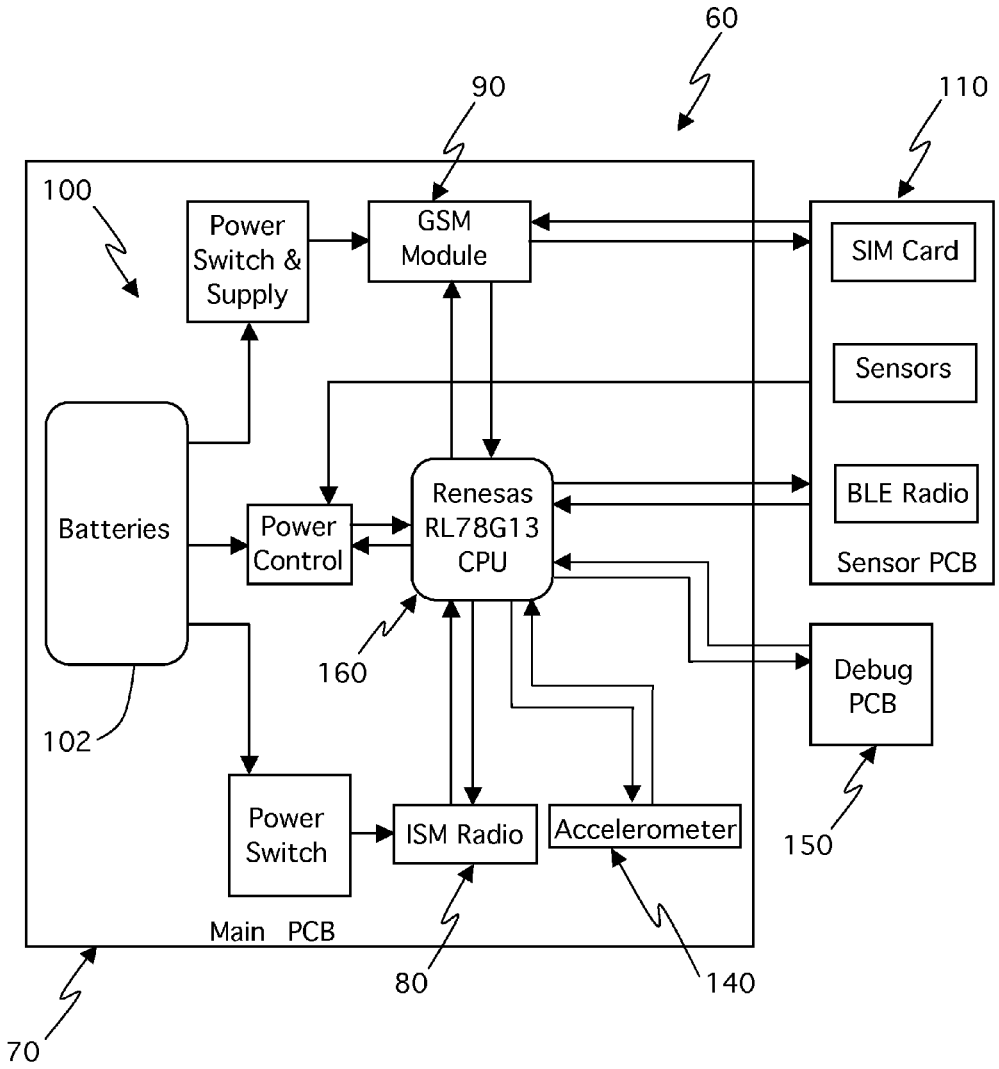
FIG. 6 is a system block diagram of the self-contained container breach detector.
Figure 7A:
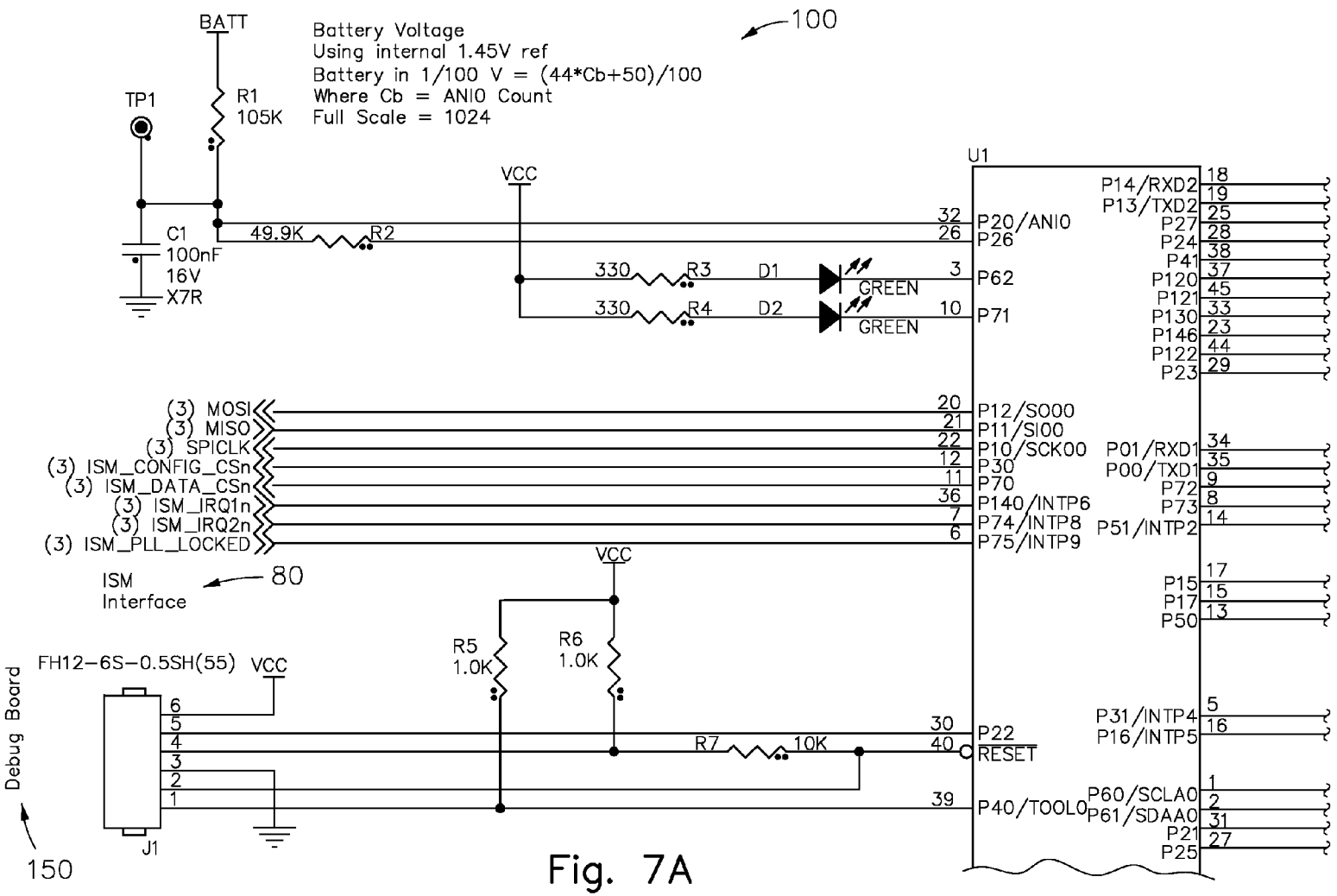
FIGS. 7A-7D are a microprocessor and peripherals electrical schematic.
Figure 7B:
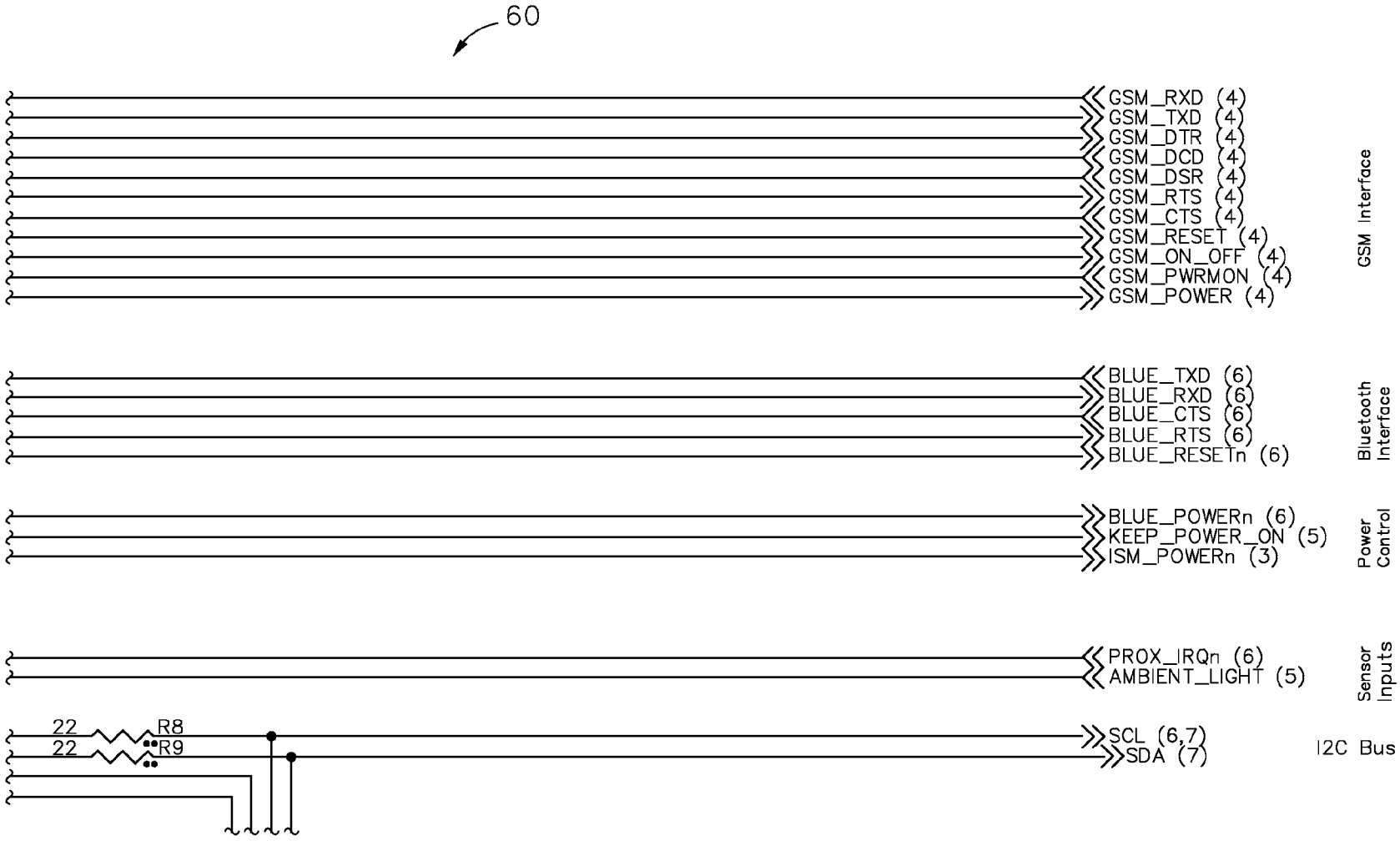
Figure 7C:
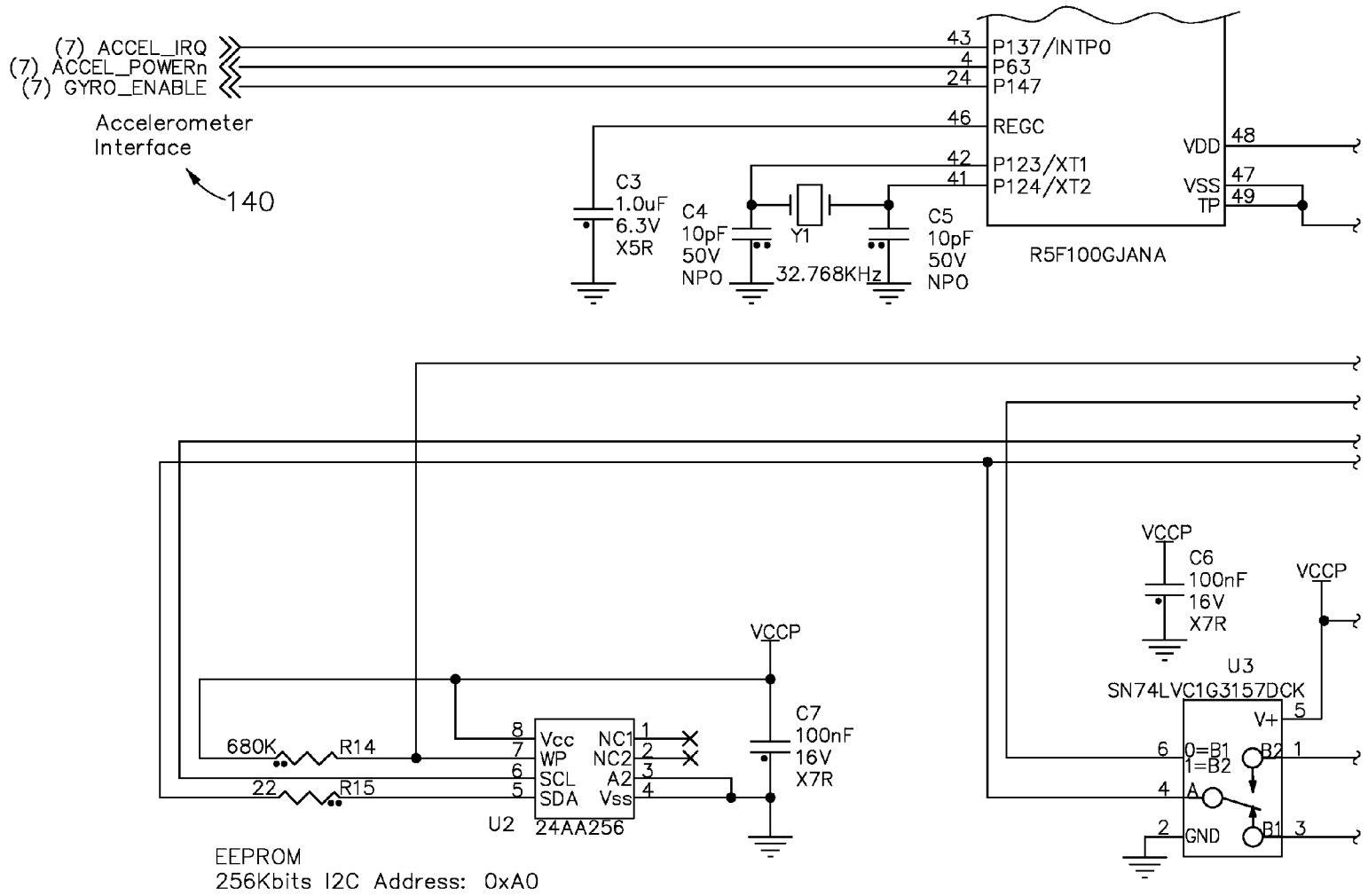
Figure 7D:
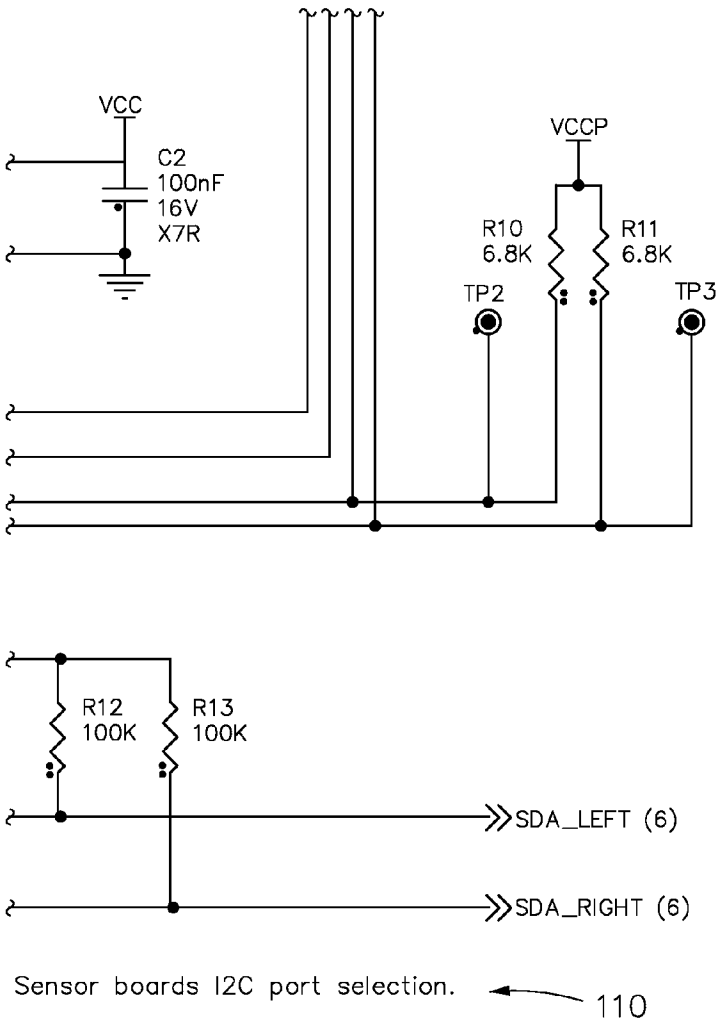

Seen in FIG. 6, is an example system block diagram of electrical system 60, comprising main printed circuit board 70; ISM band radio circuitry 80; GSM radio module circuitry 90; power circuitry 100 having batteries 102; sensors, wireless technology standard, and SIM card circuitry 110; accelerometer circuitry 140; de-bug printed circuit board 150; and CPU 160.

Seen in FIGS. 7A-7D, is an example microprocessor and peripherals electrical schematic of electrical system 60. Electrical system 60 comprises ISM band radio circuitry 80; power circuitry 100; sensors, wireless technology standard, and SIM card circuitry 110; accelerometer circuitry 140; and de-bug printed circuit board 150 that may be used to test instant invention 10. Optionally upon manufacturing, electrical system 60 further comprises memory means to store desired e-mail and/or firmware addresses.

Figure 8A:
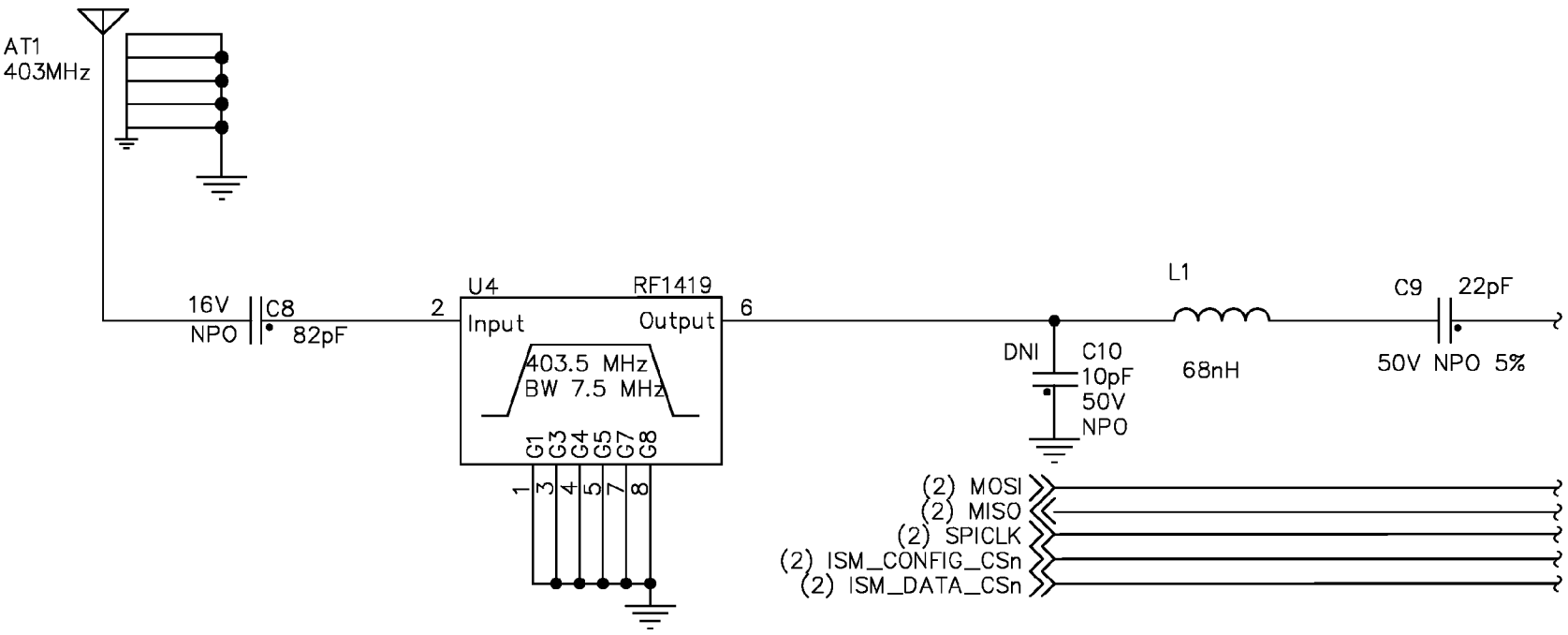
FIGS. 8A-8C are an ISM band radio electrical schematic.
Figure 8B:
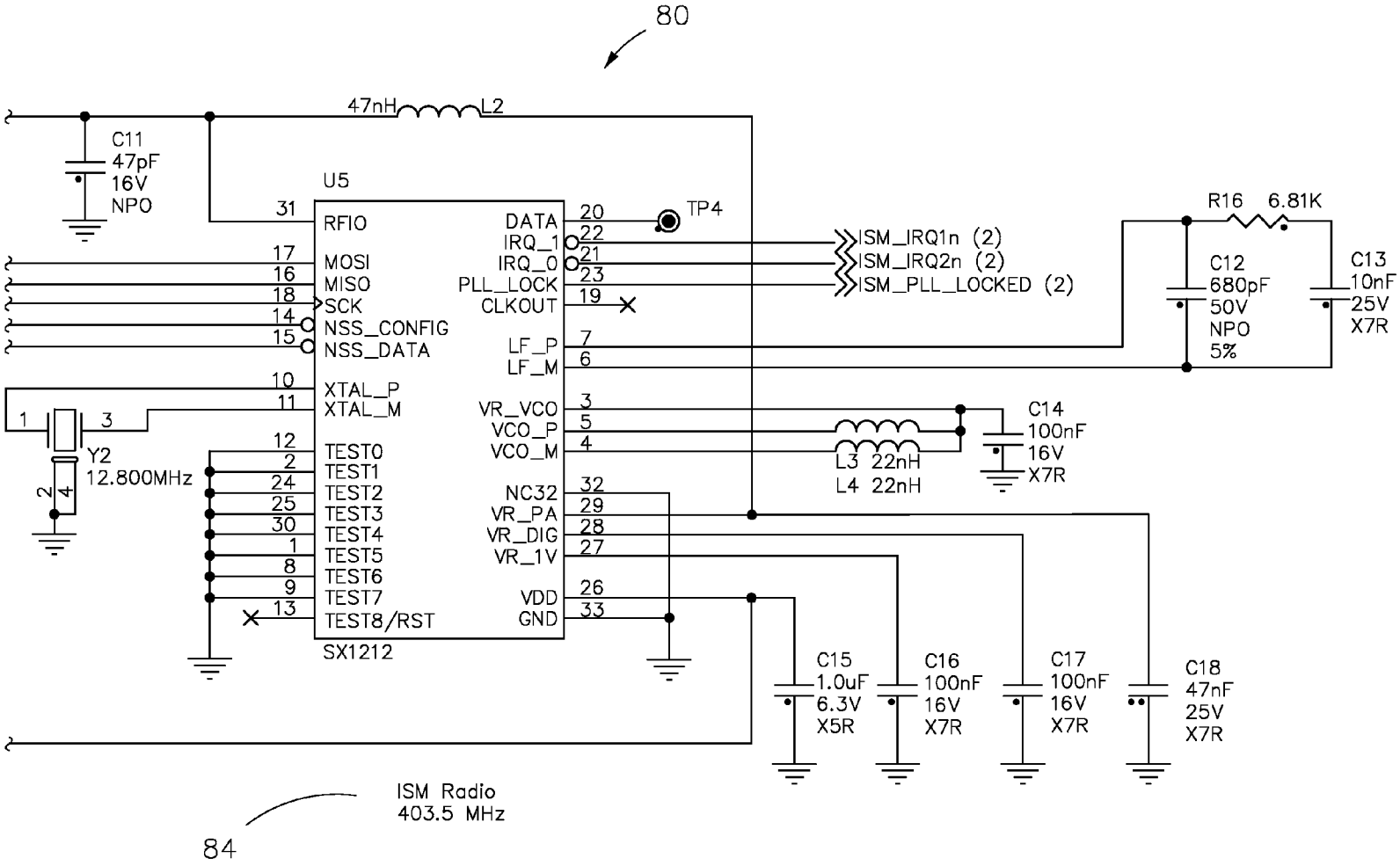
Figure 8C:
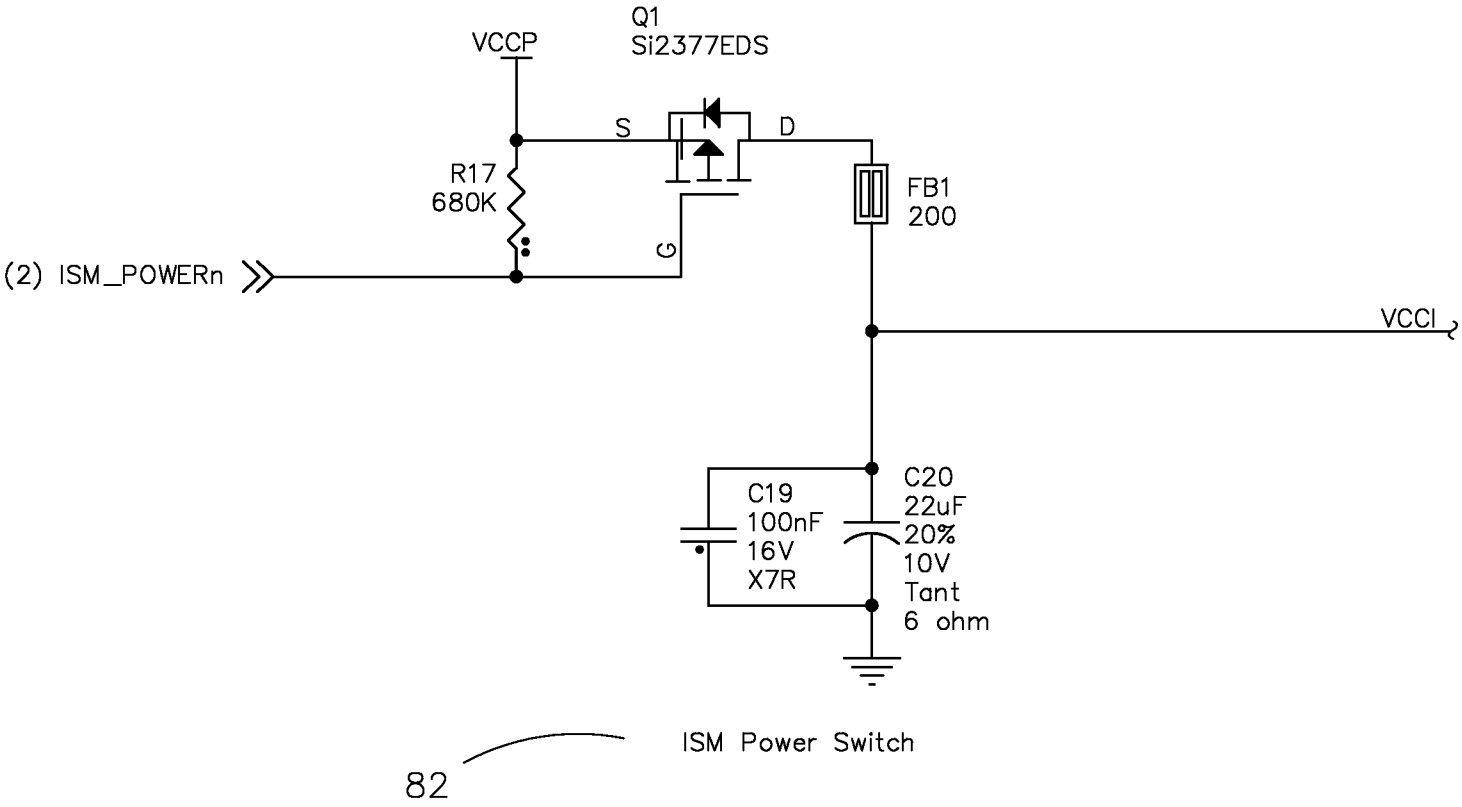
Figure 9A:
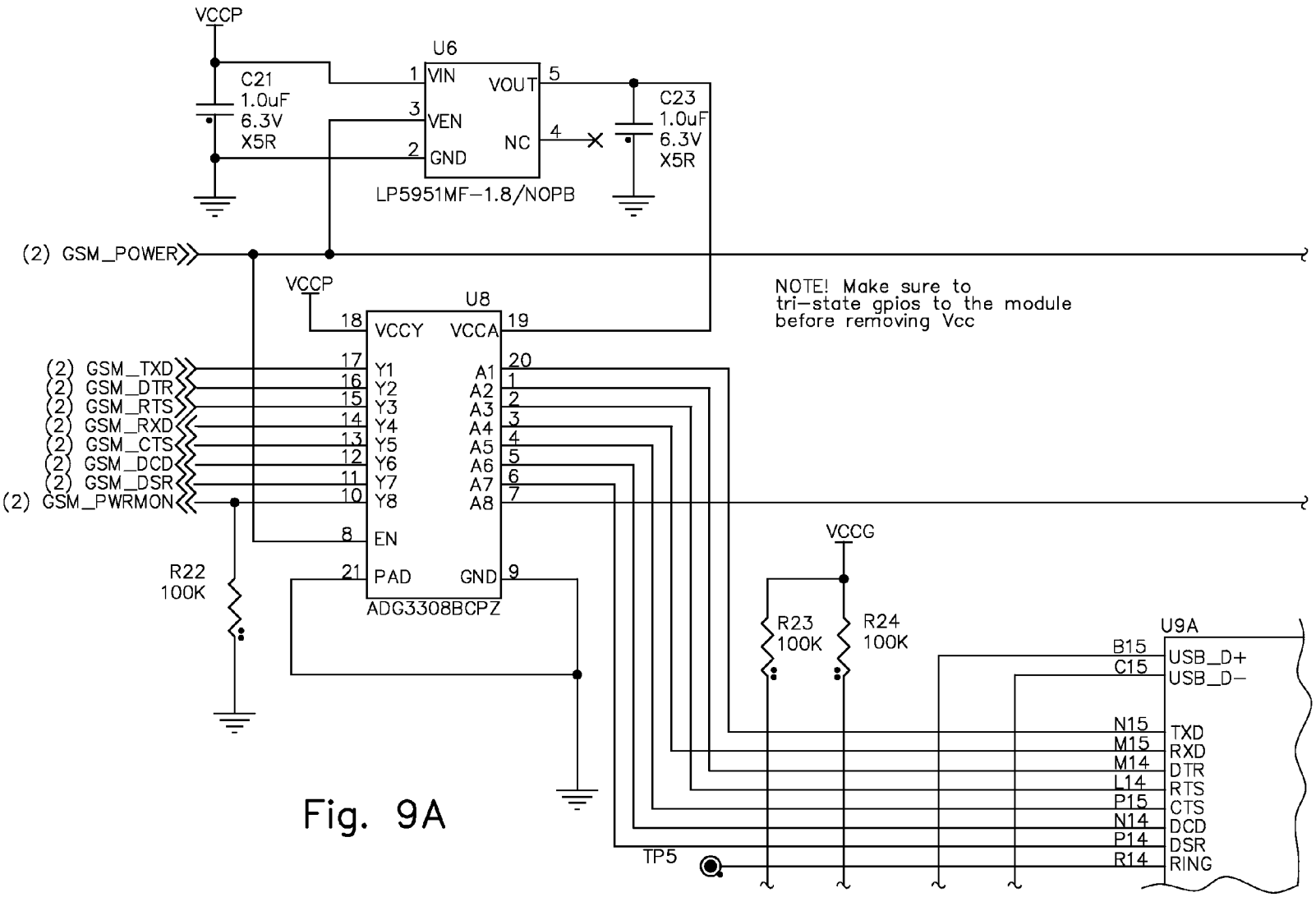
FIGS. 9A-9D are a GSM radio module electrical schematic.
Figure 9B:
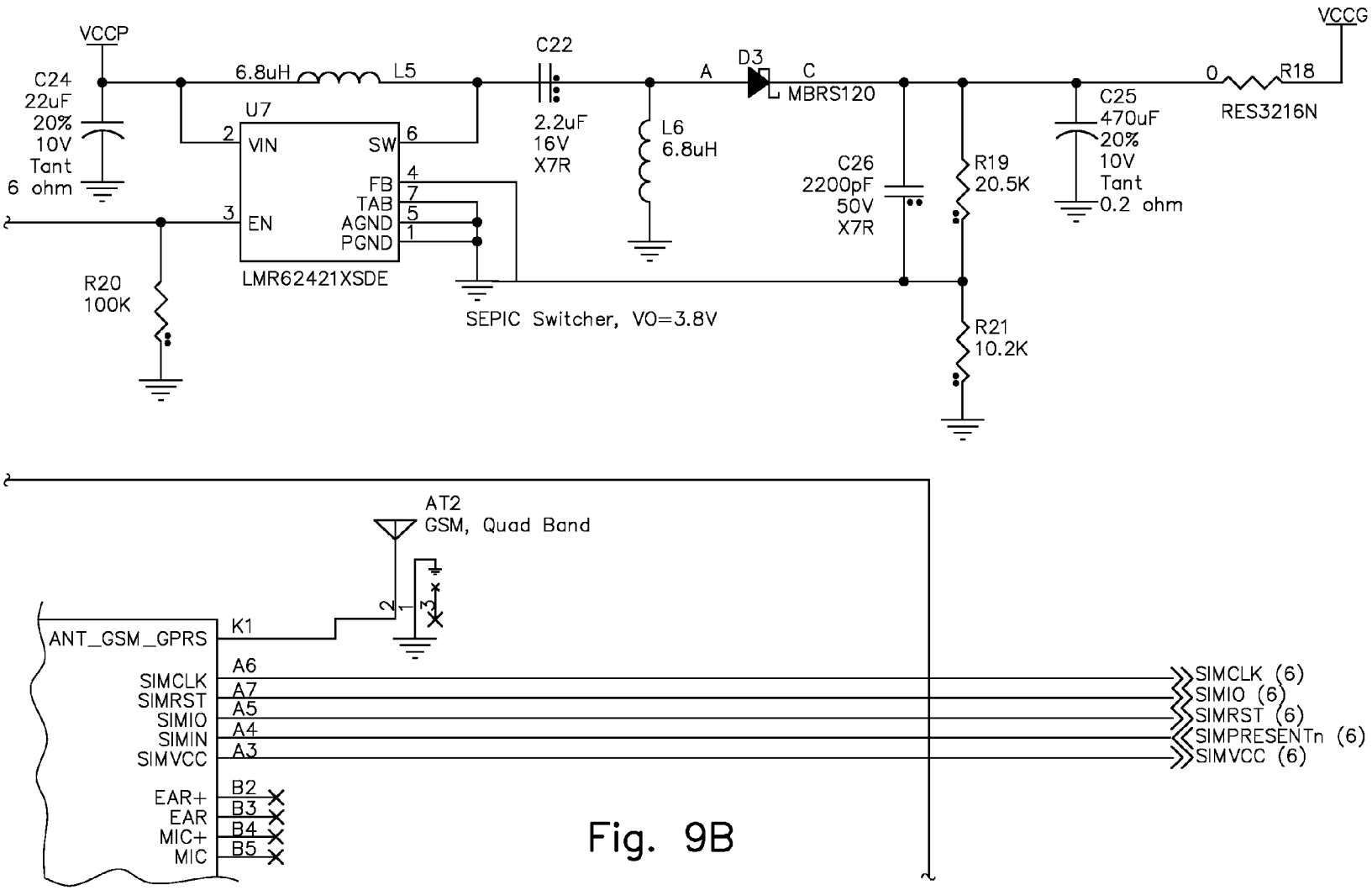
Figure 9C:
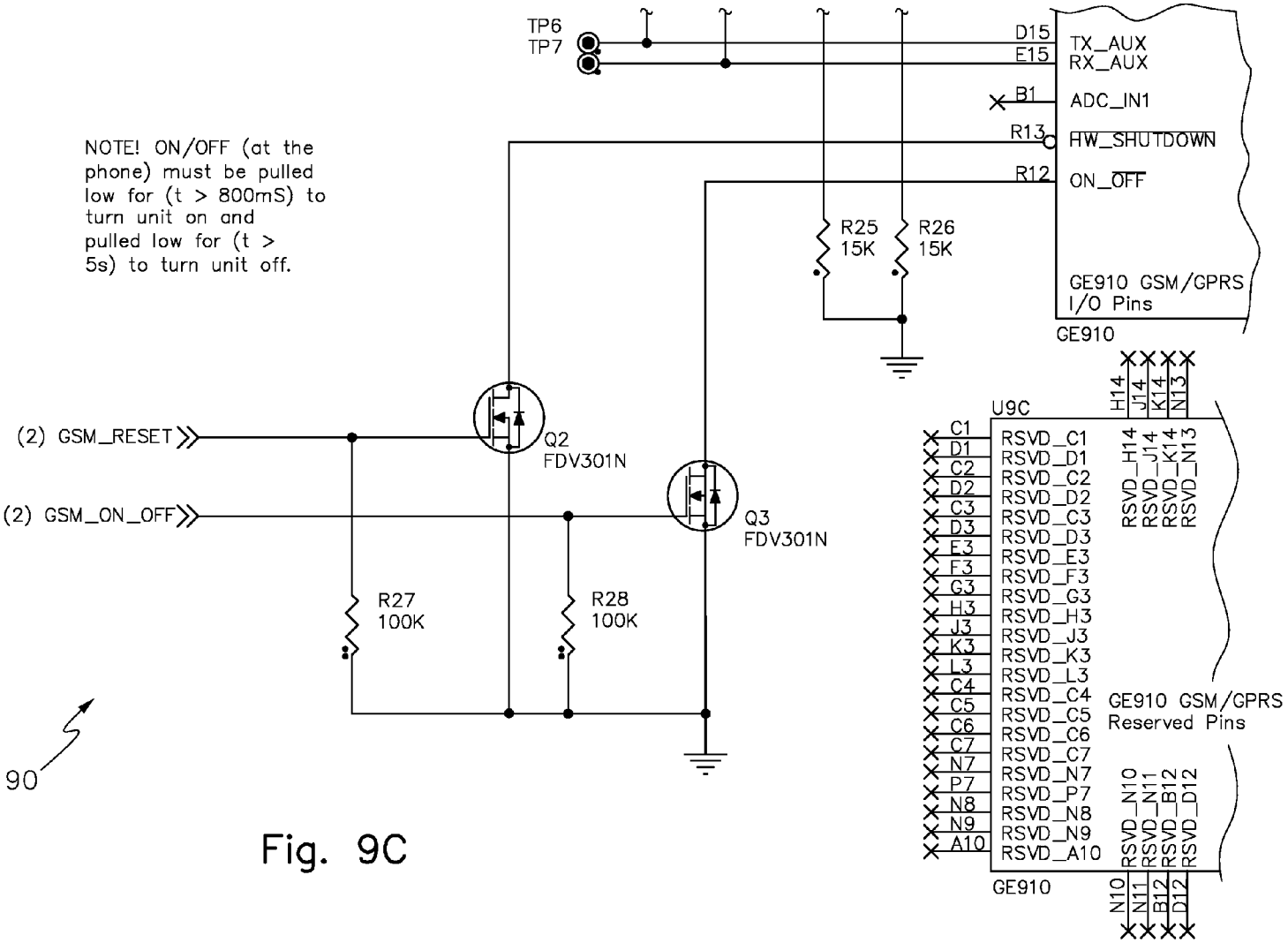
Figure 9D:
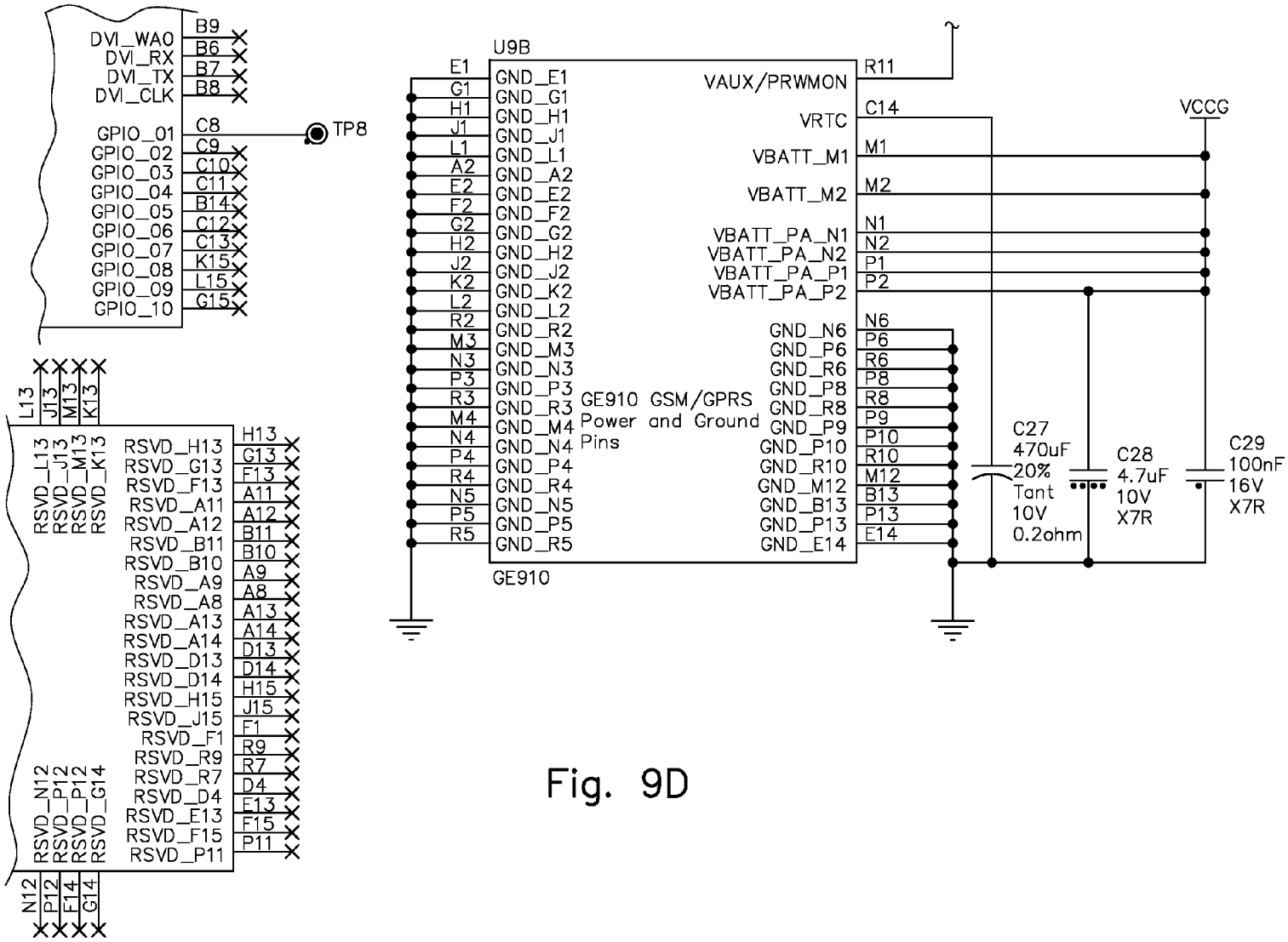

Seen in FIGS. 8A-8C, is an example ISM band radio electrical schematic. ISM band radio circuitry 80 comprises remote control means to function as a remote control. To function as a remote control includes the ability for a user to request activation, breach, and/or status event date and time stamp data from self-contained container breach detector 20. The remote control means comprises ISM power switch 82 and ISM radio 84.

Seen in FIGS. 9A-9D, is an example GSM radio module electrical schematic. GSM radio module circuitry 90 comprises communication means to communicate data and/or to transmit the activation, breach, and/or status event date and time stamp data via communication towers 200, seen in FIG. 13, to and from self-contained container breach detector 20.

Figure 10A:
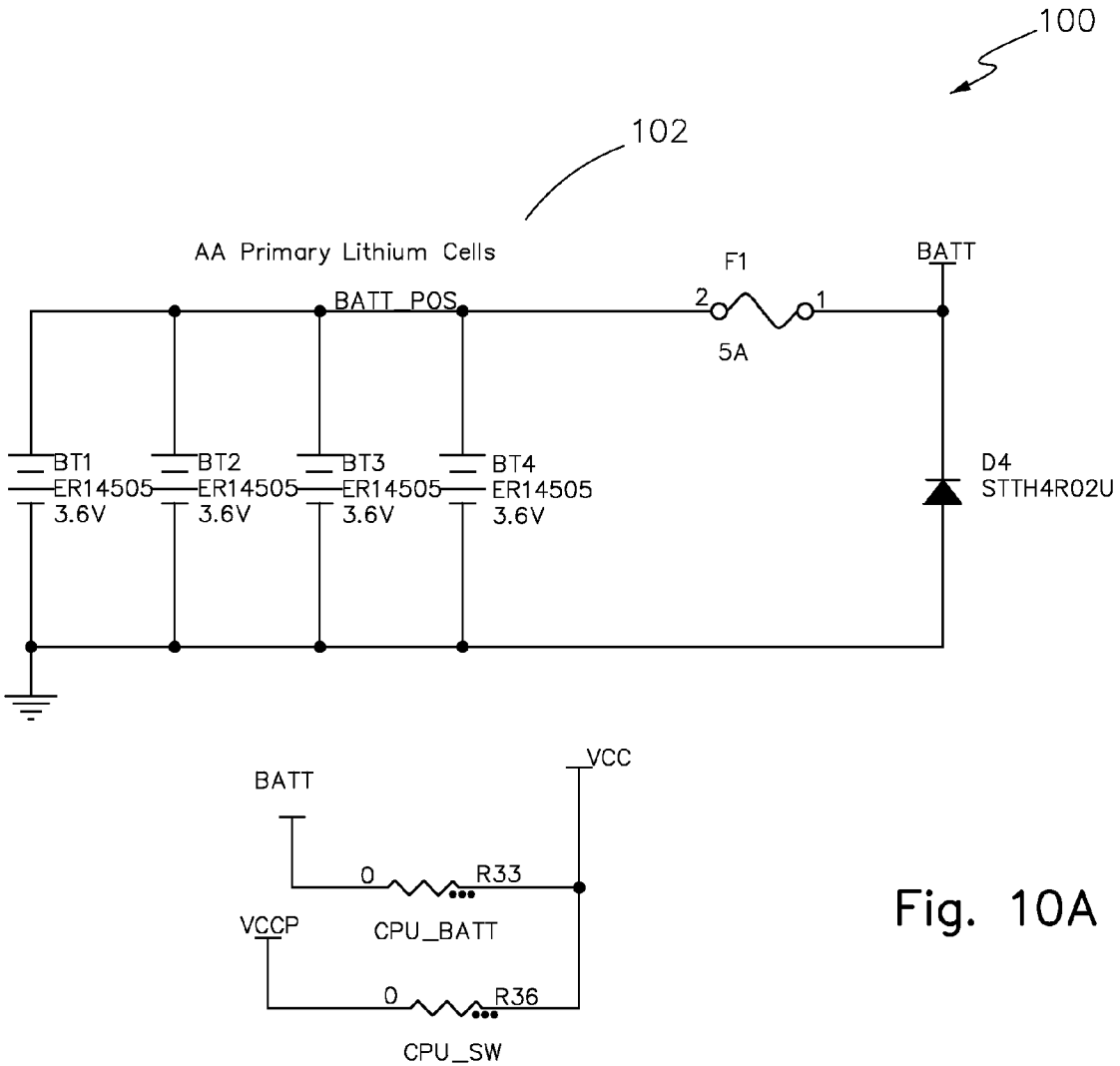
FIG. 10A is a first power electrical schematic comprising at least one battery.

Seen in FIG. 10A, is an example power electrical schematic. Power circuitry 100 comprises power means to power self-contained container breach detector 20. The power means comprises at least one battery 102. In a preferred embodiment, at least one battery 102 are AA primary lithium cells.

Figure 10B:
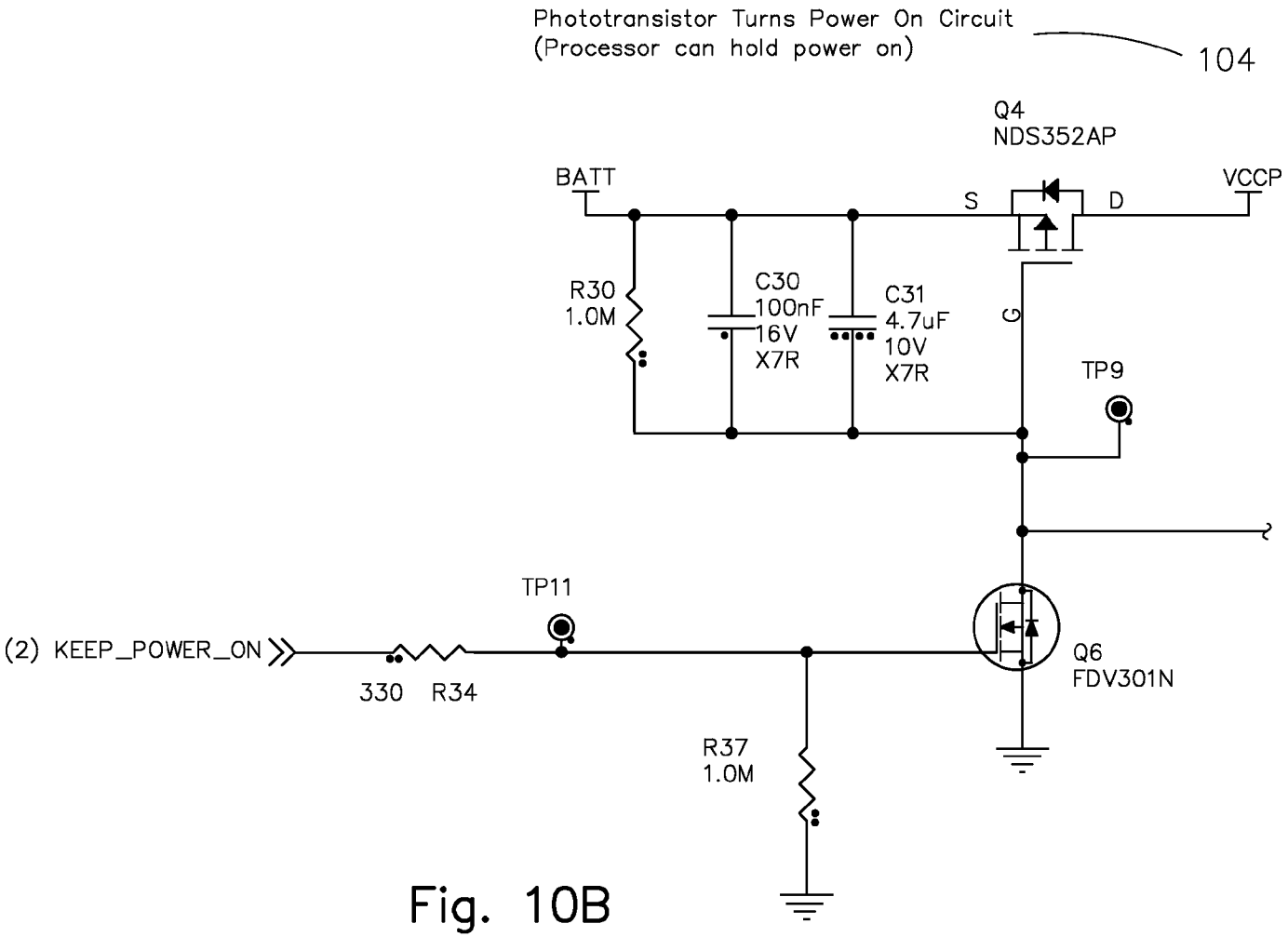
FIGS. 10B-10C are a second power electrical schematic comprising at least one phototransistor.
Figure 10C:
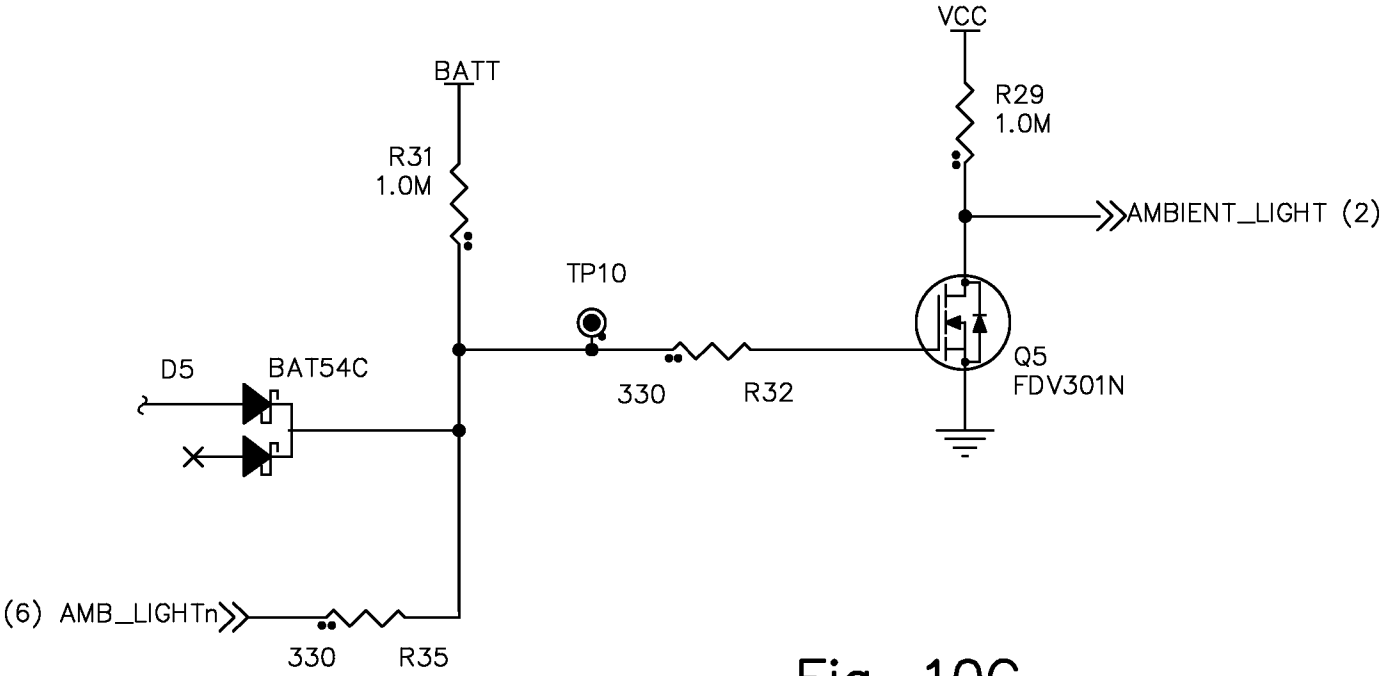
Figure 11A:
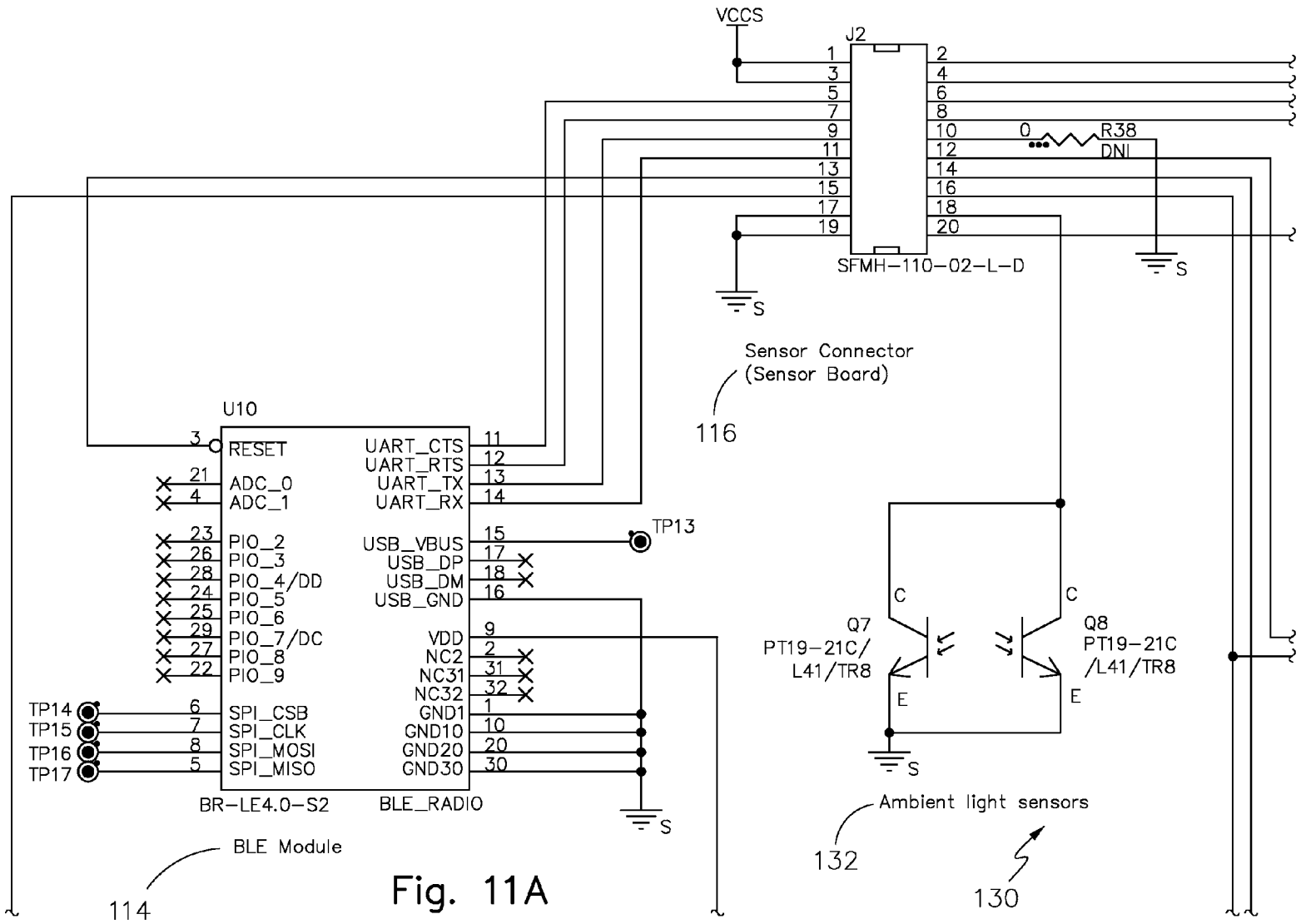
FIGS. 11A-11D are a sensors, wireless communications, and SIM card electrical schematic.
Figure 11B:
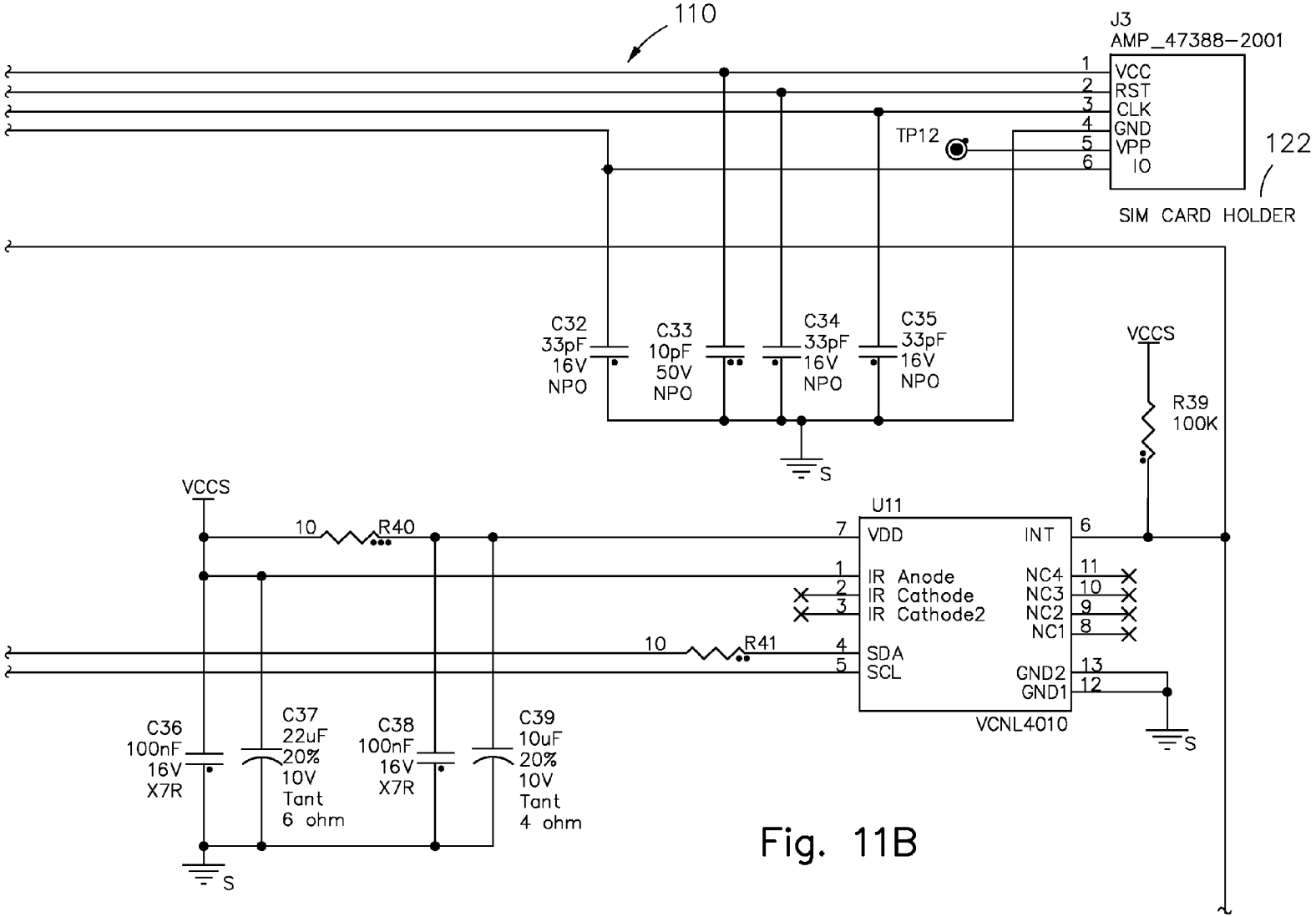
Figure 11C:
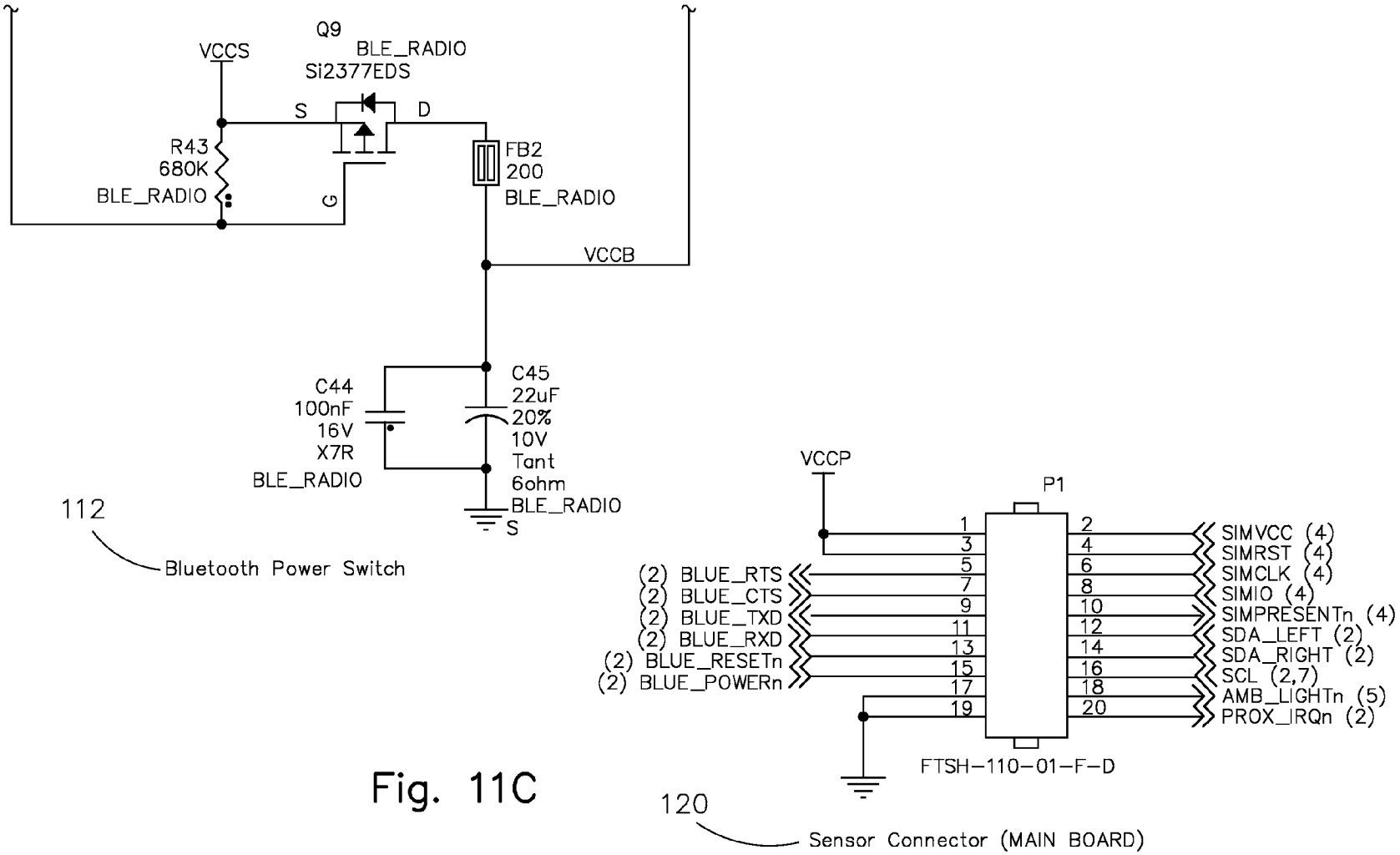
Figure 11D:
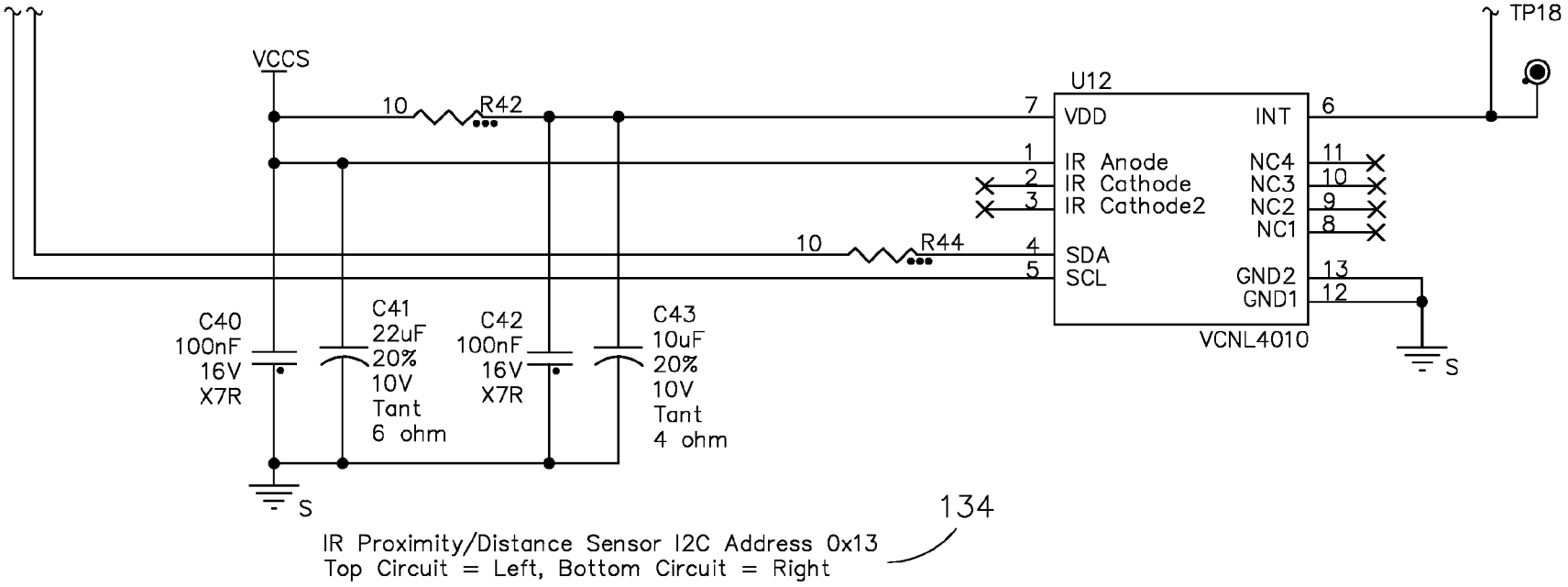

Seen in FIGS. 10B-10C, is another example power electrical schematic. Power circuitry 100 also comprises phototransistor 104 that turns power "on" for electrical system 60 when at least one ambient light sensor 132 detects light, and/or when at least one IR proximity and distance sensor 134 detects a proximity or distance change of internal faces 174; defining a possible breach. It is noted that any light entering transportation container 170 may activate at least one ambient light sensor 132. Such light may enter transportation container 170 if any door of transportation container 170 is opened, and/or if any opening is made to transportation container 170.

Seen in FIGS. 11A-11D is an example sensors, wireless communications, and SIM card electrical schematic. Sensors, wireless communications, and SIM card circuitry 110 comprises wireless communications power switch 112, wireless communications low energy module 114, sensor corrector sensor board 116, sensor corrector main board 120, SIM card holder 122, and sensors 130. Sensors 130 comprise at least one ambient light sensor 132, and at least one IR proximity and distance sensor 134.

Figure 12A:
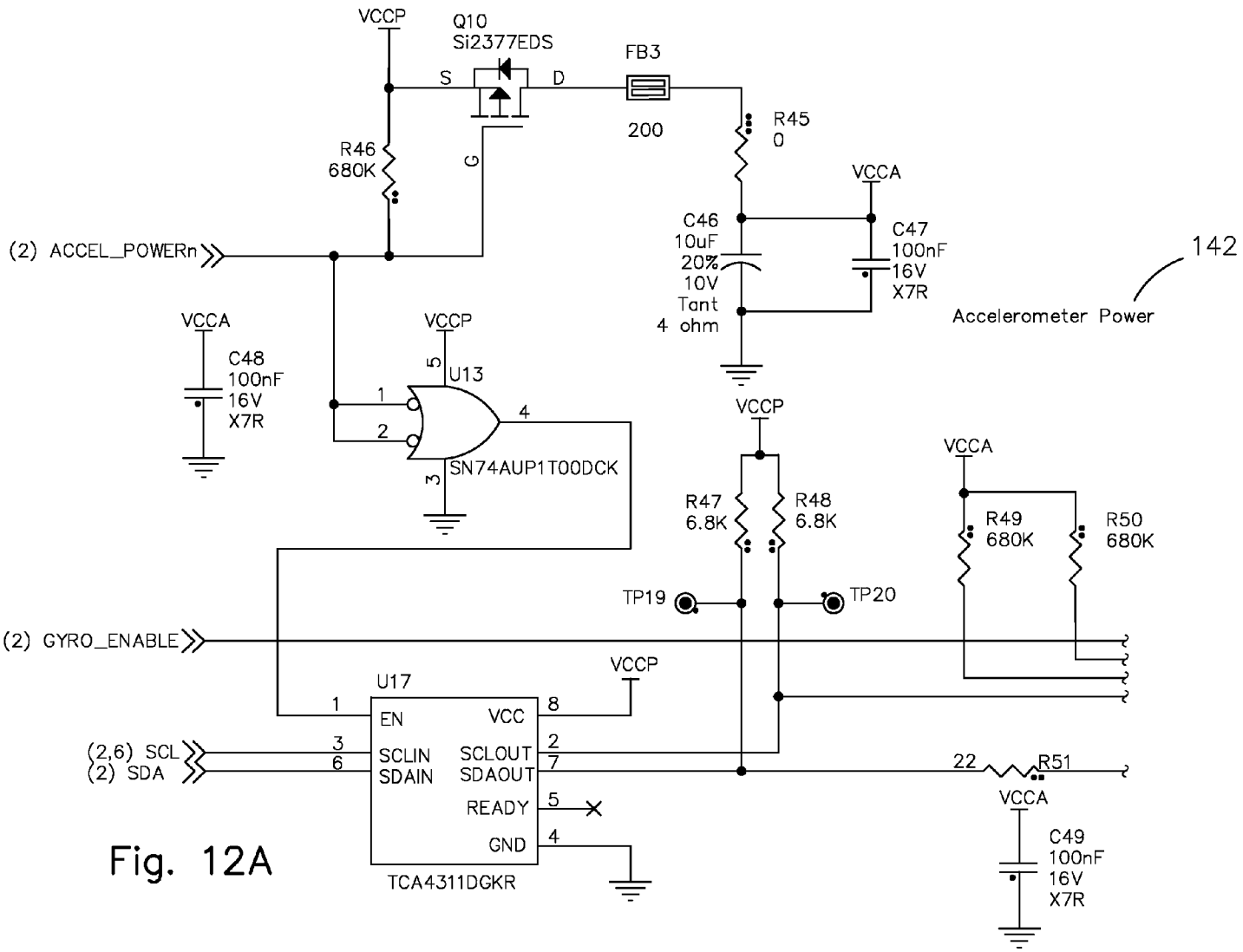
FIGS. 12A-12B are an accelerometer electrical schematic.
Figure 12B:
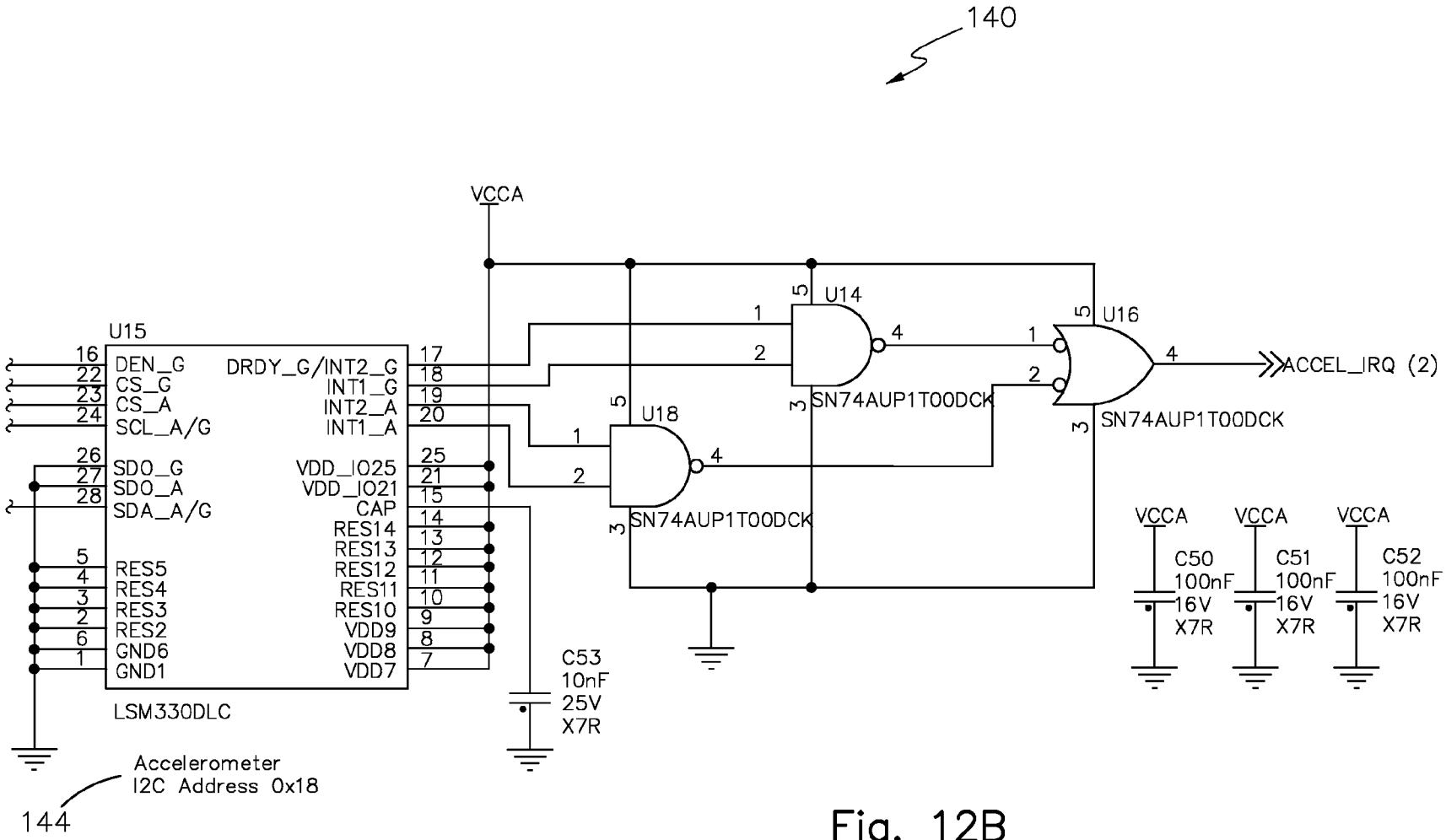

Seen in FIGS. 12A-12B is an example accelerometer electrical schematic. Accelerometer circuitry 140 comprises accelerometer means to measure proper acceleration. The accelerometer means comprises accelerometer power 142 and accelerometer 144. Accelerometer circuitry 140 may also be configured to save power of at least one battery 102 battery when accelerometer 144 measures proper acceleration, such as while traveling on ship 190, seen in FIG. 13. Accelerometer 144 may also record and/or trigger an alarm if it registers an impact or shock impact. Such an impact or shock impact may be the result of a drop, or sudden movement, impact or collision of transportation container 170.

Figure 13:
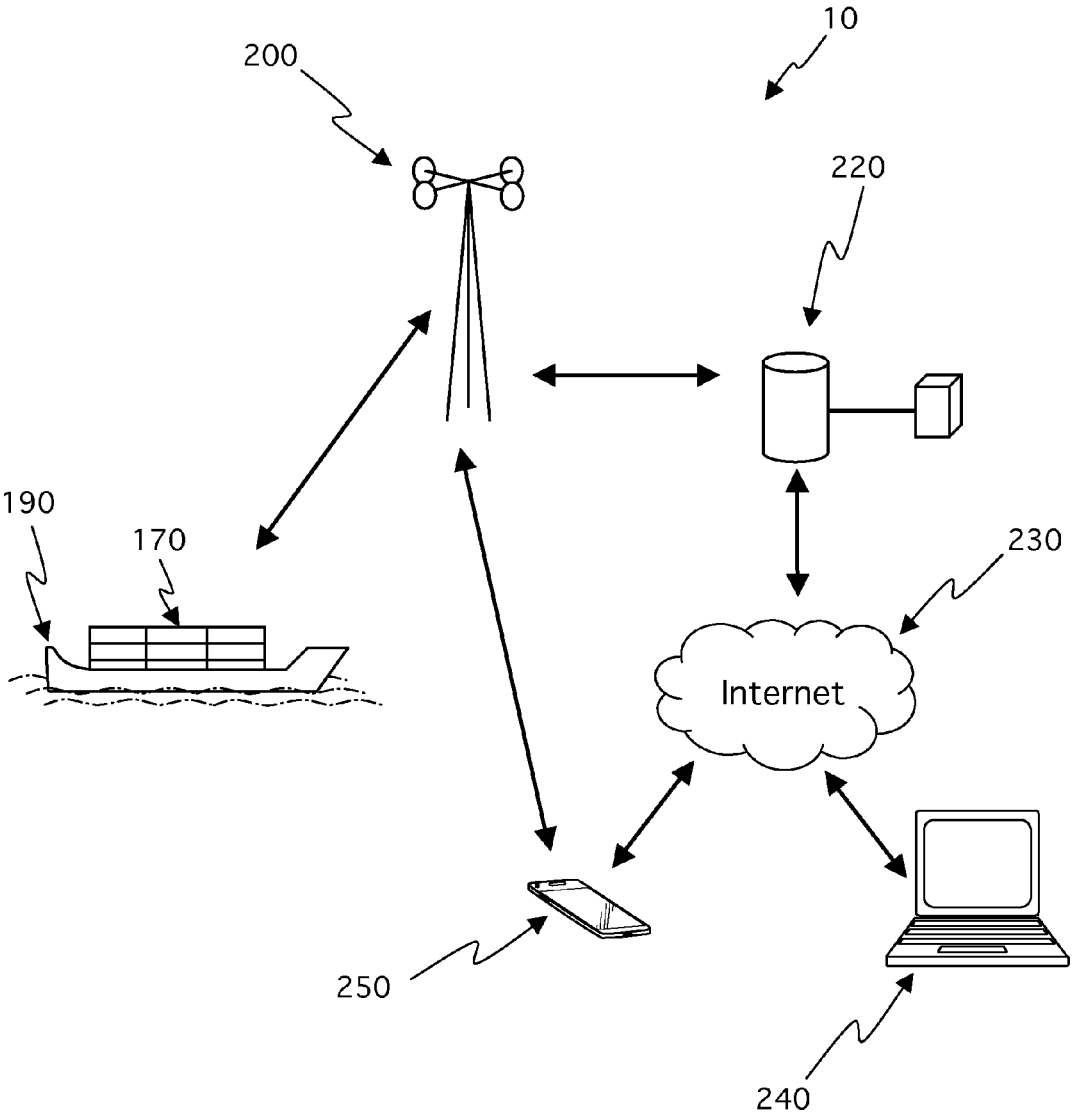
FIG. 13 is a system block diagram of the container breach detector system.

Seen in FIG. 13 is a system block diagram of the present invention container breach detector system 10. In operation, once transportation container 170 is loaded with desired contents and matter:

A) self-contained container breach detector 20 is mounted onto top frame 172 with double-sided tape 50, where the doors of transportation container 170 meet, in the orientation such that sensors 130 face internal faces 174. It is noted that self-contained container breach detector 20 is self-contained and that its installation is simple, not requiring tools;

B) to activate self-contained container breach detector 20, cover labels not seen, are removed from sensors 130, therefore causing sensors, wireless communications, and SIM card circuitry 110 to record and send an activation event date and time stamp data that includes a unique identification number of a respective communication tower 200. The activation event date and time stamp data may be sent via GSM radio module circuitry 90 to communication towers 200 and then to an operations center having at least one server(s) and/or computer(s) 220.

It is noted that communication towers 200 may also be defined as terrestrial towers, and/or a cell site. It is noted that each of communication towers 200 has its own unique identification number. A cell site is a site where antennas and electronic communications equipment are placed, usually on a radio mast, tower or other high place, to create a cell (or adjacent cells) in a cellular network. The elevated structure typically supports antennas, and one or more sets of transmitter/receivers transceivers, digital signal processors, control electronics, a GPS receiver for timing, primary and backup electrical power sources, and sheltering. A cell site is sometimes called a cell tower, even if the cell site antennas are mounted on a building rather than a tower. In GSM networks, the technically correct term is Base Transceiver Station (BTS), and synonyms are mobile phone mast or base station. The term base station site might better reflect the increasing co-location of multiple mobile operators, and therefore multiple base stations, at a single site. Depending on an operator's technology, even a site hosting just a single mobile operator may house multiple base stations, each to serve a different air interface technology (CDMA2000 or GSM, for example).

The operations center having at least one server(s) and/or computer(s) 220 may also send the activation event date and time stamp data via Internet 230 to designated computers 240 and/or cell phones 250. The activation event date and time stamp data, including the unique identification number of communication tower 200, may be sent by the various communication means of present invention 10 including text via short message service, SMS, and/or e-mail;

C) the doors of transportation container 170 are closed and locked;

D) while transportation container 170, having self-contained container breach detector 20 therein, is in communication towers' 200 working range, and sensors 130 are activated, and specifically either at least one ambient light sensor 132, and/or at least one IR proximity and distance sensor 134; sensors, wireless communications, and SIM card circuitry 110 records and sends a breach event date and time stamp data that includes the unique identification number of a respective communication tower 200. As with the activation event date and time stamp data, the breach event date and time stamp data may be sent via GSM radio module circuitry 90 to communication towers 200 and then to the operations center having at least one server(s) and/or computer(s) 220. The operations center having at least one server(s) and/or computer(s) 220 may also send the breach event date and time stamp data via Internet 230 to designated computers 240 and/or cell phones 250. The breach event date and time stamp data, including the unique identification number of a communication tower 200, may also be sent be sent by the various communication means of present invention 10 including text via short message service, SMS, and/or e-mail;

E) self-contained container breach detector 20 may also be programmed to send status event date and time stamp data at predetermined time periods. As an example, predetermined time periods may be 24, or 36, or 48 hours, or days, or weeks. The status event date and time stamp data may include information as to whether sensors 130 were activated, and specifically either at least one ambient light sensor 132, and/or at least one IR proximity and distance sensor 134. As with the activation and breach event date and time stamp data, the status event date and time stamp data may be sent via GSM radio module circuitry 90 to communication towers 200 and then to the operations center having at least one server(s) and/or computer(s) 220. The operations center having at least one server(s) and/or computer(s) 220 may also send the status event date and time stamp data via Internet 230 to designated computers 240 and/or cell phones 250. The status event date and time stamp data, including the unique identification number of a communication tower 200, may also be sent be sent by the various communication means of present invention 10 including text via short message service, SMS, and/or e-mail;

F) if transportation container 170, having self-contained container breach detector 20 therein, is not within communication towers' 200 working range, and a predetermined time period is reached and/or sensors 130 are activated, and specifically either at least one ambient light sensor 132, and/or at least one IR proximity and distance sensor 134; sensors, wireless communications, and SIM card circuitry 110 records and attempts to send the status and/or breach event date and time stamp data that includes the unique identification number of a respective communication tower 200; and G) when transportation container 170, having self-contained container breach detector 20 therein, is again within in a communication towers' 200 working range; sensors, wireless communications, and SIM card circuitry 110 sends all recorded status and/or breach event date and time stamp data, if any, and the unique identification number of a respective communication tower 200, via GSM radio module circuitry 90 to communication towers 200 and then to the operations center having at least one server(s) and/or computer(s) 220. The operations center having at least one server(s) and/or computer(s) 220 may also send said each status and/or breach event date and time stamp data, if any, via Internet 230 to designated computers 240 and/or cell phones 250. Said each status and/or breach event date and time stamp data may be sent by the various communication means of present invention 10 including text via short message service, SMS, and/or e-mail.

It is noted that from communication towers 200, the activation, breach, and status event date and time stamp data may also be sent directly to cell phones 250.

Figure 14:
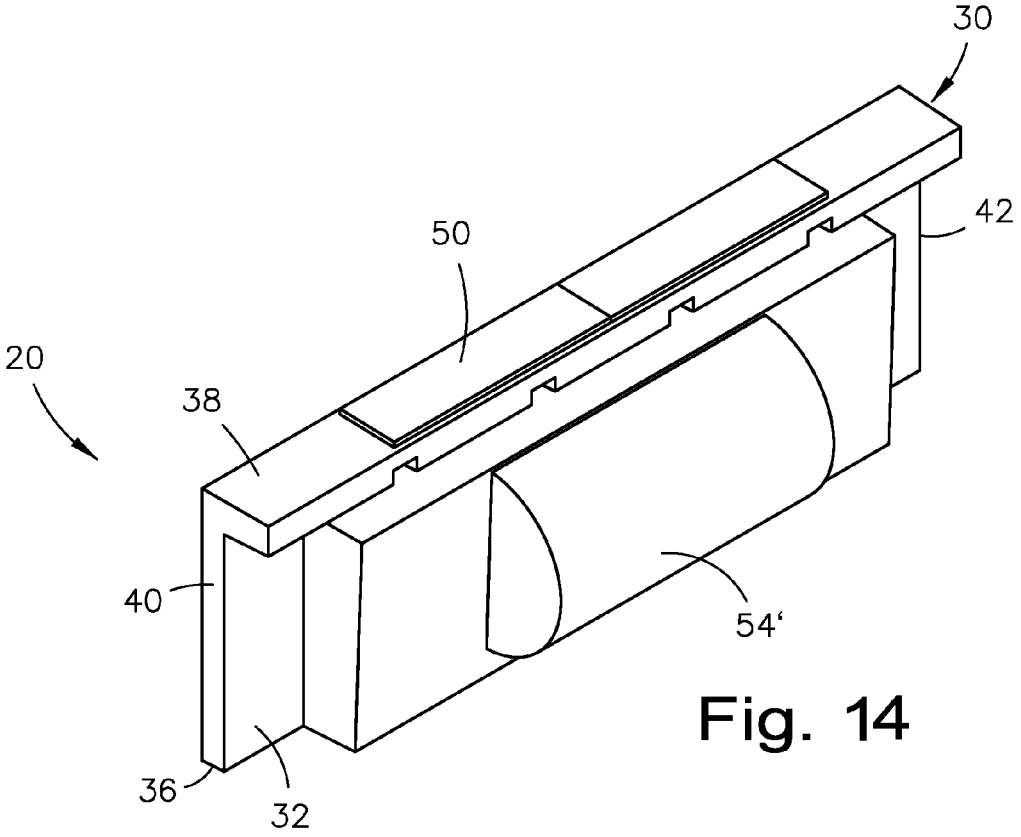
FIG. 14 is an isometric view of an alternate embodiment self-contained container breach detector.

Seen in FIG. 14 is an isometric view of alternate embodiment self-contained container breach detector 20. Housing 30 comprises exterior wall 32 defined between bottom edge 36 and top wall 38, and lateral edges 40 and 42. Extending outwardly a predetermined distance from exterior wall 32 is protruding wall 54'. Protruding wall 54' is cooperatively shaped to snugly accommodate components of electrical system 60 within housing 30, and specifically at least one battery 102, which in this case is a D-cell type battery, not seen.

Present invention 10 therefore is a container breach detector system to monitor breaches of transportation container 170. Self-contained container breach detector 20 provides activation, status, and/or breach event date and time stamp data for a user to determine when and where authorized and/or unauthorized breaches of transportation container 170 occurred. Furthermore, self-contained container breach detector 20 serves as a recording device to record the activation, status, and/or breach event date and time stamp data; and communicates via various communication means including text via short message service, SMS, and/or e-mail. Self-contained container breach detector 20 is intended for a one-time use only, to be discarded at destination. Each self-contained container breach detector 20 has individual serial numbers, as bolt seals for transportation containers 170 currently have. Encapsulating composition 56 ensures that self-contained container breach detector 20 is used only once, and is not removed, recharged and reused, whereby removal of encapsulating composition 56 would damage electrical system 60.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A container breach detector system, comprising a self-contained container breach detector comprising a housing and an electrical system, said self-contained container breach detector further comprises an encapsulating composition, said encapsulating composition ensures that said self-contained container breach detector is used only once, whereby removal of said encapsulating composition damages said electrical system, said encapsulating composition is an optically clear epoxy chemical composition filling within said housing to cover said electrical system, said self-contained container breach detector is mounted onto a top door frame of a transportation container, said transportation container has first and second doors with respective internal faces, said self-contained container breach detector is positioned between said first and second doors and is entirely mounted within said transportation container with double-sided tape and monitors breaches of said transportation container, said electrical system comprises:

A) a main printed circuit board;

B) a global system for mobile communications radio module circuitry comprising cellular network communication means with capabilities to communicate directly to and from a public cellular receiver tower positioned at a working range from said self-contained container breach detector;

C) power circuitry comprising power means;

D) sensors comprising at least one ambient light sensor and at least one IR proximity and distance sensor, wireless technology standard, and subscriber identity module card circuitry, said at least one ambient light sensor activates when it detects light entering said transportation container when breached, said first and second doors each cover said at least one ambient light sensor and said at least one IR proximity and distance sensor, said at least one IR proximity and distance sensor detects a proximity or distance change of either of said internal faces when either of respective said first and second doors is opened;

E) a central processing unit; and

F) accelerometer circuitry comprising accelerometer means to measure proper acceleration.

2. The container breach detector system set forth in claim 1, further characterized in that said self-contained container breach detector provides activation, status, and/or breach event date and time stamp data and a unique identification number of said public cellular receiver tower being a communication tower, to identify when and where authorized and/or unauthorized breaches of said transportation container occurred.

3. The container breach detector system set forth in claim 1, further characterized in that said self-contained container breach detector provides activation, status, and/or breach event date and time stamp data and a unique identification number of said public cellular receiver tower being a communication tower, to identify when and where authorized and/or unauthorized breaches of said transportation container occurred when said at least one ambient light sensor and/or said at least one IR proximity and distance sensor is activated, whereby said at least one ambient light sensor faces at least one door of said transportation container said internal faces of said first and second doors.

4. The container breach detector system set forth in claim 1, further characterized in that said self-contained container breach detector serves as a recording device to record activation, status, and/or breach event date and time stamp data and a unique identification number of said public cellular receiver tower being a communication tower.

5. The container breach detector system set forth in claim 4, further characterized in that recorded said activation, status, and/or breach event date and time stamp data and said unique identification number of said communication tower, is communicated via said cellular network communication means including text via short message service, SMS, and/or internet protocol communications including TCP/IP, UDP/IP, and e-mail, to respective said communication tower.

6. The container breach detector system set forth in claim 4, further characterized in that recorded said activation, status, and/or breach event date and time stamp data and said unique identification number of said communication tower, is communicated via said cellular network communication means including text via short message service, SMS, and/or internet protocol communications including TCP/IP, UDP/IP, and e-mail, to an operations center having at least one server(s) and/or computer(s).

7. The container breach detector system set forth in claim 4, further characterized in that recorded said activation, status, and/or breach event date and time stamp data and said unique identification number of said communication tower, is communicated via said cellular network communication means including text via short message service, SMS, and/or internet protocol communications including TCP/IP, UDP/IP, and e-mail, via Internet to designated computers and/or cell phones.

8. The container breach detector system set forth in claim 4, further characterized in that recorded said activation, status, and/or breach event date and time stamp data and said unique identification number of said communication tower, is communicated via said cellular network communication means to cell phones.

9. The container breach detector system set forth in claim 1, further characterized in that said sensors, wireless technology standard, and subscriber identity module card circuitry are mounted onto said main printed circuit board facing outwardly.

10. The container breach detector system set forth in claim 1, comprises an industrial, scientific and medical band radio circuitry comprising remote control means to function as a remote control to request activation, status, and/or breach event date and time stamp data and a unique identification number of said public cellular receiver tower being a communication tower, to identify when and where authorized and/or unauthorized breaches of said transportation container occurred, said remote control means comprises an ISM power switch and an ISM radio.

11. The container breach detector system set forth in claim 1, further characterized in that said accelerometer circuitry comprises an accelerometer, said accelerometer circuitry configured to save power of said electrical system when said accelerometer measures said proper acceleration while said transportation container is traveling on a ship, said accelerometer also records and/or triggers an alarm if it registers an impact or shock impact resulting from a drop, sudden movement, impact or collision of said transportation container.

12. The container breach detector system set forth in claim 1, further characterized in that said housing comprises an exterior wall defined between a bottom edge and a top wall, and first and second lateral edges, extending outwardly a predetermined distance from said exterior wall is a protruding wall, said protruding wall is cooperatively shaped to snugly accommodate components of said electrical system within said housing.

13. The container breach detector system set forth in claim 12, further characterized in that adhered onto said top wall is said double-sided tape, opposite said exterior wall is a rear edge, an outside diameter of said rear edge is of a cooperative shape, and slightly larger than an outside diameter of a main printed circuit board, to receive it, whereby said electrical system is embedded within said housing through said rear edge.

14. A container breach detector system, comprising a self-contained container breach detector comprising a housing and an electrical system, said self-contained container breach detector further comprises an encapsulating composition, said encapsulating composition ensures that said self-contained container breach detector is used only once, whereby removal of said encapsulating composition damages said electrical system, said encapsulating composition is an optically clear epoxy chemical composition filling within said housing to cover said electrical system, said self-contained container breach detector is mounted onto a top door frame of a transportation container, said transportation container has first and second doors with respective internal faces, said self-contained container breach detector is entirely mounted within said transportation container with double-sided tape and monitors breaches of said transportation container, said electrical system comprises:

A) a main printed circuit board;

B) a global system for mobile communications radio module circuitry comprising cellular network communication means with capabilities to communicate directly to and from a public cellular receiver tower positioned at a working range from said self-contained container breach detector;

C) power circuitry comprising power means;

D) sensors comprising at least one ambient light sensor and at least one IR proximity and distance sensor, wireless technology standard, and subscriber identity module card circuitry, said at least one ambient light sensor activates when it detects light entering said transportation container when breached, said first and second doors each cover said at least one ambient light sensor and said at least one IR proximity and distance sensor, said at least one IR proximity and distance sensor detects a proximity or distance change of either of said internal faces when either of respective said first and second doors is opened;

E) a central processing unit; and

F) accelerometer circuitry comprising an accelerometer to measure proper acceleration, said accelerometer circuitry configured to save power of said electrical system when said accelerometer measures said proper acceleration while said transportation container is traveling on a ship, said accelerometer also records and/or triggers an alarm if it registers an impact or shock impact resulting from a drop, sudden movement, impact or collision of said transportation container, said self-contained container breach detector is programmed to transmit status event date and time stamp data at predetermined time periods regardless of its state and also provides activation, status, and/or breach event date and time stamp data and a unique identification number of said public cellular receiver tower being a communication tower, to identify when and where authorized and/or unauthorized breaches of said transportation container occurred.

15. The container breach detector system set forth in claim 14, further characterized in that said self-contained container breach detector provides said activation, status, and/or breach event date and time stamp data and said unique identification number of said communication tower to identify when and where authorized and/or unauthorized breaches of said transportation container occurred when said at least one ambient light sensor and/or said at least one IR proximity and distance sensor is activated, whereby said at least one ambient light sensor faces said internal faces of said first and second doors.

16. The container breach detector system set forth in claim 14, further characterized in that said self-contained container breach detector serves as a recording device to record said activation, status, and/or breach event date and time stamp data and said unique identification number of said communication tower.

17. The container breach detector system set forth in claim 16, further characterized in that recorded said activation, status, and/or breach event date and time stamp data and said unique identification number of said communication tower, is communicated via said cellular network communication means including text via short message service, SMS, and/or internet protocol communications including TCP/IP, UDP/IP, and e-mail, to respective said communication tower.

18. The container breach detector system set forth in claim 16, further characterized in that recorded said activation, status, and/or breach event date and time stamp data and said unique identification number of said communication tower, is communicated via said cellular network communication means including text via short message service, SMS, and/or internet protocol communications including TCP/IP, UDP/IP, and e-mail, to an operations center having at least one server(s) and/or computer(s).

19. The container breach detector system set forth in claim 16, further characterized in that recorded said activation, status, and/or breach event date and time stamp data and said unique identification number of said communication tower, is communicated via said cellular network communication means including text via short message service, SMS, and/or internet protocol communications including TCP/IP, UDP/IP, and e-mail, via Internet to designated computers and/or cell phones.

20. The container breach detector system set forth in claim 16, further characterized in that recorded said activation, status, and/or breach event date and time stamp data and said unique identification number of said communication tower, is communicated via said cellular network communication means to cell phones.

* * * * *

UNITED STATES PATENT AND TRADEMARK OFFICE

CERTIFICATE OF CORRECTION

PATENT NO. : 9,460,593 B2
APPLICATION NO. : 13/828114
DATED : October 4, 2016
INVENTOR(S) : Enrique Acosta et al.

It is certified that error appears in the above-identified patent and that said Letters Patent is hereby corrected as shown below:

On the Title Page

Item (75) INVENTORS: please add Michael Ray Wilkinson, Harley Michael Willey, Preston Taylor Thorpe, Lyndl Brent Duncan, Gustavo Gerado Suarez Signed and Sealed this
Sixteenth Day of May, 2017

Michelle K. Lee

Michelle K. Lee
*Director of the United States Patent and Trademark Office*